US012660865B2

(12) United States Patent
Ho et al.

(10) Patent No.: US 12,660,865 B2
(45) Date of Patent: Jun. 23, 2026

(54) UPPER-TORSO SUPPORT GARMENT

(71) Applicant: NIKE, Inc., Beaverton, OR (US)

(72) Inventors: Fanny Yung Ho, Portland, OR (US); Amy L. Toth, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 59 days.

(21) Appl. No.: 18/341,399

(22) Filed: Jun. 26, 2023

(65) Prior Publication Data

US 2023/0413926 A1 Dec. 28, 2023

Related U.S. Application Data

(60) Provisional application No. 63/355,967, filed on Jun. 27, 2022.

(51) Int. Cl.
*A41C 3/00* (2006.01)
*A41C 3/04* (2006.01)

(52) U.S. Cl.
CPC ..... *A41C 3/0014* (2013.01); *A41C 3/0071* (2013.01); *A41C 3/04* (2013.01)

(58) Field of Classification Search
CPC ..... A61M 1/062
USPC ..... 450/36, 37, 38, 39
See application file for complete search history.

(56) References Cited

U.S. PATENT DOCUMENTS 7,214,121 B1 * 5/2007 Huang ..... A41C 3/10 450/38
2004/0166766 A1 * 8/2004 Schneider ..... A41D 1/215 450/36
2005/0085160 A1 * 4/2005 Johnstone ..... A41C 3/04 450/36
2009/0265831 A1 * 10/2009 Hendrickson ..... A41C 3/08 2/104
2011/0314587 A1 * 12/2011 Ritchie ..... A41C 3/04 2/104

(Continued)

FOREIGN PATENT DOCUMENTS

DE 29916482 U1 12/1999
GB 2536541 A 9/2016

OTHER PUBLICATIONS

International Preliminary Report on Patentability received for PCT Patent Application No. PCT/US2023/026353, mailed on Oct. 10, 2024, 13 pages.

(Continued)

*Primary Examiner* — Matthew R Marchewka
(74) *Attorney, Agent, or Firm* — SHOOK, HARDY & BACON L.L.P.

(57) ABSTRACT

An upper-torso support garment includes an outer layer and an inner layer that together define interlayer compartments for retaining objects such as breast pumps or prosthetics. A material extension spans between middle regions of the outer and inner layers from a neck-opening edge to a torso-opening edge, creating separate chambers and providing increased volume and retention. The outer layer includes paired breast-covering portions and a lower elastic section secured to an underband, while the inner layer includes aligned breast-covering portions with openings sized to receive a pump flange. Combinations of elastomeric, mesh, spacer-knit, and molded textile panels impart elasticity, support, breathability, and comfort suitable for everyday wear and physical activity.

33 Claims, 10 Drawing Sheets

(56) References Cited

U.S. PATENT DOCUMENTS

| | | | | |
|---|---|---|---|---|
| 2014/0273737 | A1 | 9/2014 | Cortese et al. | |
| 2017/0303606 | A1* | 10/2017 | Curry | A41F 15/002 |
| 2020/0085113 | A1* | 3/2020 | Rendone | A41C 3/10 |
| 2020/0297042 | A1 | 9/2020 | Carlino et al. | |
| 2021/0084995 | A1* | 3/2021 | Eldreth | A41C 3/0028 |
| 2021/0219628 | A1 | 7/2021 | Rendone | |

OTHER PUBLICATIONS

International Search Report and Written Opinion received for PCT Patent Application No. PCT/US2023/026353, mailed on Sep. 18, 2023, 17 Pages.

* cited by examiner

UPPER-TORSO SUPPORT GARMENT

CROSS REFERENCE TO RELATED APPLICATIONS

This application claims the priority benefit of U.S. Provisional Application No. 63/355,967 (filed Jun. 27, 2023), which is incorporated herein by reference in its entirety.

TECHNICAL FIELD

Aspects herein are directed to a support garment having features to facilitate hands-free breast milk pumping.

BACKGROUND

Traditional support garments (e.g., bras) may include features that optimize the support garment for some uses or purposes (e.g., nursing by an infant or for normal wear). But these features may not be as conducive for breast-milk pumping, especially in view of some common structures of breast pumps (e.g., hands-free breast pumps or wearable breast pumps). For example, traditional nursing bras may not securely seat the pump or retain the pump in position, and as such, the breast pump may shift in use, which may negatively impact the pumping action of the pump. Additionally, breast pumps are often positioned by sliding the pump into a space between the wearer's breast and an inner surface of the support garment, and as such, besides problems with shifting as noted above, traditional support garments may not expand to accommodate the pump, which may be uncomfortable for the wearer. Furthermore, traditional support garments that might also be worn while using breast pumps often do not include features conducive to physical activity, such as exercising, sports, and other fitness-related activities. Although some aspects of this disclosure describe subject matter related to breast pumps, aspects herein further contemplate that these same considerations may also cause issues with respect to securely seating and/or accommodating prosthetics (e.g., such as breast prosthetics) or other objects (e.g., cushions, inserts, protective equipment, etc.) that may be retained or held in position by a support garment.

BRIEF DESCRIPTION OF THE DRAWINGS

Examples of this disclosure are described in detail below with reference to the attached drawing figures.

DETAILED DESCRIPTION

Figure 1:
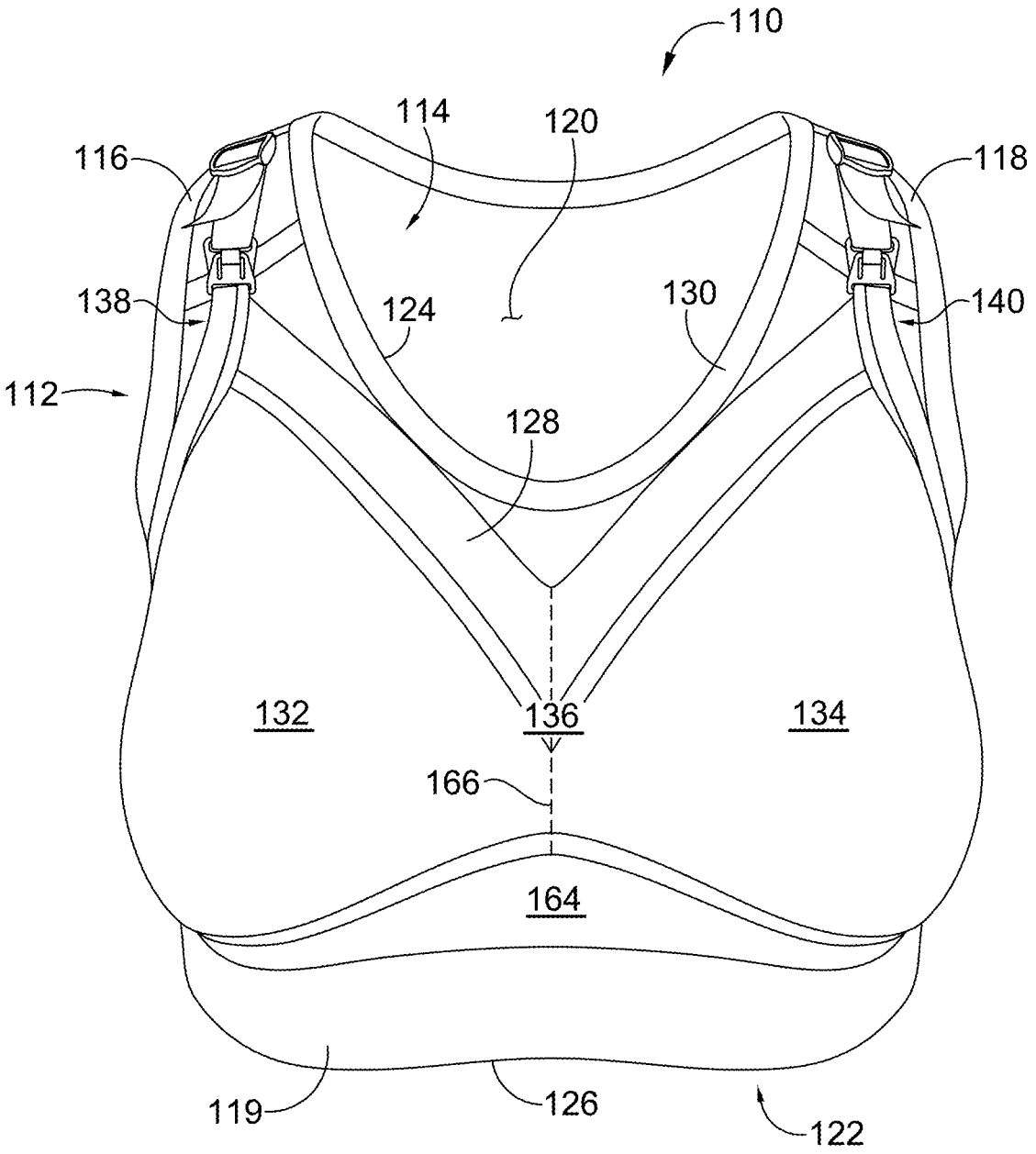
FIG. 1 depicts a support garment in accordance with an aspect of the present disclosure.

The present disclosure is related to a support garment (e.g., bra) that may help retain a breast pump, prosthetic, or other object in position (e.g., near the breast-covering portions of the support garment) and that may, in some examples, be conducive for wearing during physical activity, such as exercising, sports activities, fitness activities, and the like. For example, the support garment may include a multilayer structure that includes one or more interlayer compartments (e.g., compartments that are between layers) for housing the object. In addition, the support garment may include a material extension (e.g., a gusset or other panel structure) secured near a central region (e.g., bridge or other portion near a midline and between breast-covering portions) of the support garment that may form a divider between the interlayer compartments. In some examples, the material extension may help retain the object in position and reduce the likelihood that the object might shift positions while contained in the interlayer compartment.

In some instances the support garment may include, at various locations, one or more different textiles that have different relative material properties (e.g., elasticity, breathability, permeability, thermal retention, etc.), which may contribute to enhanced support and comfort (e.g., to the wearer), while also providing a robust compartment for the object. As such, the subject matter of the present disclosure may provide, among other things, a support garment that is conducive to retaining an object (e.g., breast pump, prosthetic, etc.) in a position, while also providing a level of support, comfort, and other properties conducive to physical activity and/or every day wear.

In contrast to the subject matter of the present disclosure, conventional bras may include features that optimize the bra for some uses (e.g., nursing by an infant or for normal wear), but these features may be less conducive or useful for breast-milk pumping, especially in view of some common structures for hands-free "wearable" breast pumps (e.g., ELVIE® Pump or WILLOW® Pump (i.e., hands-free wearable breast pumps)). For example, conventional nursing bras may not securely seat the pump which allows for shifting of the breast pump during use which may negatively impact the pumping action of the pump. Additionally, these types of breast pumps are typically positioned by sliding the pump into a space between the wearer's breast and an inner surface of the bra. Besides problems with shifting as noted above, traditional bras may not expand to accommodate the pump which may be uncomfortable for the wearer. Although aspects discuss the disadvantages of traditional bras with respect to breast pumps, aspects herein further contemplate that these same features may also cause issues with respect to securely seating and/or accommodating prosthetics such as breast prosthetics.

The subject matter of the present disclosure may include various aspects. For instance, as indicated above, aspects herein are directed to a support garment, which may be in the form of a bra, that includes features facilitating the secure seating and accommodation of, for example, breast pumps (e.g., including hands-free breast pumps or wearable breast pumps), and/or other types of prosthetics (e.g., including breast prosthetics). In example aspects, a front portion of the support garment includes a first layer (e.g., outer layer or external layer) having a first breast-covering portion, a second breast-covering portion, and a first middle region positioned between the first and second breast-covering portions.

In examples, the first layer (e.g., outer layer or external layer) can include features and properties that are conducive use with a breast pump (e.g., positioning, securing, retaining, etc.), as well as without a breast pump, such as in every-day use contexts and/or athletic or fitness-related contexts. For example, the first layer can include a combination of different materials having different properties that work together to provide a set of properties, including compression, breathability, modesty, encapsulation, wicking, moisture obfuscation (e.g., related to breast milk, sweat, etc.), and the like. Examples of materials that might be combined can include an elastomeric textile (e.g., knit elastane), a mesh textile, a spacer mesh (e.g., spacer knit textile), as well as other knits, wovens, nonwovens, and films. In some examples, these textiles can be layered, one on top of the other. In some examples, these textiles can comprise different pattern pieces that are seamed together to form the first layer.

In some examples, one or more portions of the first layer can include a molded portion that is configured to help accommodate a breast pump. In addition, the molded portions can also be configured to help conform to, or encapsulate, the wearer's breast. Furthermore, molding can help accommodate changes in the wearer's breast size (e.g., before and after pumping; as milk production increases or decreases post-partum; etc.). In at least some examples, inner layers of the first layer can included molded portions (e.g., molded cups), without a more external or outer layer also including corresponding molded portions, which can contribute to a cleaner aesthetic associated with the support garment and with clothes worn over the support garment.

In some examples, the first layer (e.g., the outer layer or external layer) can include regions or zones that made of different textiles. For example, the first and second breast-covering portions may each include a respective central region formed of a relatively low-stretch material and a lower section formed of a relatively high-stretch material. A bottom edge of the lower section may be secured to an underband, and in this configuration, the lower section formed of the relatively high-stretch material may act as an expandable gusset, which may expand to accommodate a breast pump, a prosthetic, and the like. The central region formed of the low-stretch material is positioned to overlay a nipple area of the wearer or other central portion of the wearer's breast area. When, for example, a breast pump is attached to the wearer's nipple, the low-stretch central region helps to secure or seat the pump against the wearer's breast and minimize shifting of the pump during use. In addition, when a breast pump is not retained within the support garment (e.g., normal use), the lower-stretch central region and/or the higher stretch lower section may (e.g., in combination) provide a level of support conducive to physical activity (e.g., by providing both compressive and encapsulative support).

The support garment may further include a second layer that is positioned internal to the first layer. The second layer includes a third breast-covering portion, a fourth breast-covering portion, and a second middle region positioned between the third and fourth breast-covering portions. Each of the third breast-covering portion and the fourth breast-covering portion can include an opening sized to receive, for example, a flange of a breast pump. Alternatively, if the support garment is used for nursing an infant, the openings are sized to accommodate an infant's mouth and portions of the infant's face. The openings in the third and fourth breast-covering portions may be positioned interior to the central regions of the first and second breast-covering portions such that the central regions cover the openings.

In examples, the second layer may be formed of an elastically resilient mesh material having a stretch characteristic greater than the stretch characteristic of, for example, the central regions of the first and second breast-covering portions. The use of an elastically resilient mesh material for the second layer facilitates permeability and breathability and allows the material to conform to the shape of the wearer's breasts, thus improving wearer comfort. Moreover, the elastically resilient material surrounding the openings in the second layer may help to secure, for example, the flange of the breast pump against the wearer's skin surface.

In some examples, the edges of the openings may be reinforced with a trim piece or other reinforcement, which may increase the structural integrity of the edge. As such, with the trim piece or reinforcement, the opening may be less likely to lose shape or tear (e.g., due to repeated engagement with a breast pump).

In example aspects, the support garment further includes a material extension (e.g., panel, webbing, etc.) that connects the first middle region of the first layer to the second middle region of the second layer where the material extension extends from a location near a neck opening edge of the support garment to a location near to a torso opening edge of the support garment (e.g., by the underband). The material extension includes a first edge secured to the first layer and a second edge secured to the second layer and a width extending between the first and second edges. In example aspects, the width is from about 1 cm to about 4 cm. This construction effectively creates two separate "compartments" where each compartment may accommodate, for example, a breast pump or a prosthetic or another object (e.g., cushion, padding, protective article, etc.). The material extension helps to seat the breast pumps or prosthetics such that they do not shift past the midline when positioned within one of the compartments. Further, using a material extension having a width between the first and second edges instead of simply securing the first and second middle regions together using stitching, provides the compartments with a greater volume to better accommodate the volume of the breast pump or prosthetic making the support garment more comfortable to wear.

In example aspects, a first shoulder strap extends from an upper edge of the third breast-covering portion, and a second shoulder strap extends from an upper edge of the fourth breast-covering portion. In example aspects, an upper edge of the first breast-covering portion may be releasably secured to the first shoulder strap, and an upper edge of the second breast-covering portion may be releasably secured to the second shoulder strap. When a wearer wishes to position a breast pump or prosthetic, the wearer may release the upper edge of one or more of the first and second breast-covering portions, lower the first layer to expose the opening(s) in the second layer and position the article. This may be contrasted with a more traditional bra where a wearer may need to pull down on a bra edge to seat the pump which may cause wear-and-tear on the bra.

The term "support garment" when used herein refers to an upper-body garment primarily configured to provide support to a wearer's breasts. As such, the support garment may be in the form of a bra, including a nursing bra and/or athletic bra, a tank top, an athletic top, a swimsuit top, and the like. When the garment is in the form of a support garment or bra, the term "breast-covering portion" means the portion of the support garment configured to cover a wearer's breast. In example aspects and with respect to the first and second breast-covering portions of the first layer, the breast-covering portions may cover substantially all of the wearer's breasts (e.g., up to about 90% of the surface area of the wearer's breast). As such, the breast-covering portion generally extends from a top part (e.g., near the wearer's clavicle) to a lower part (e.g., the wearer's inframammary fold) of each of the wearer's breasts and from a medial edge (e.g., near the wearer's sternum) to a lateral edge (e.g., near the wearer's axilla) of each of the wearer's breasts. In other example aspects and with respect to the third and fourth breast-covering portions, the breast-covering portions may cover portions of the wearer's breasts. For example, the breast-covering portions may cover areas surrounding the nipple area of the wearer but the nipple area may not be covered by the breast-covering portions (i.e., the nipple area may be positioned within the openings in the second layer). The term "underband" when used in relation to, for instance, a support garment or bra refers to the portion of the bra that forms a lower margin of at least the front portion of the bra. The underband is configured to encircle the torso area of a wearer and may include a separate pattern piece or may include an integral extension of a front portion of the support garment.

Positional terms used when describing the support garment such as upper, bottom, lower, middle, internal, vertically, and the like are with respect to the support garment being worn as intended with the wearer standing upright. For example, the term "inner" or "internal" means a layer or structure that is positioned closer to a body surface of a wearer as compared to other layers or structures of the support garment. The term "outer" means a layer or structure that is positioned external to other layers or structures of the support garment. In example aspects, an inner layer may be an innermost layer and an outer layer may be an outermost layer of the support garment. Portions of the support garment described as upper are located closer to a wearer's head with respect to portions of the support garment described as lower or bottom which are located closer to a wearer's feet. The term "vertical" means in a direction along an axis that extends from a wearer's head to a wearer's feet.

Terms such as "stretch characteristic" as used herein is meant to be a relative term when describing stretch properties of two different materials or layers. Thus, a material or layer that has a greater stretch characteristic compared to another material or layer would stretch or elongate further in response to an equal load. The term "elastically resilient" means that the material stretches or elongates in response to a load and generally returns to its resting length when the load is removed. Elastically resilient materials may include elastic yarns, such as spandex, that have the capacity to stretch to 100% or more of their resting length and return to their resting length when the tension force is removed.

As used herein, the material properties for burst strength, modulus of elasticity, and relative softness (e.g., based on bending or stiffness properties) can be determined using testing methodologies known to an ordinary skilled artisan in the textile arts related to wearable garments and apparel.

The term "about" as used herein means within ±10% of an indicated value. When referring to an angle, then "about" refers to +10 degrees.

Referring now to FIG. 1, an example support garment 110 is depicted. The support garment 110 includes a front portion 112 and a back portion 114, as well as a first shoulder strap 116, a second shoulder strap 118, and an underband 119. In examples, the first shoulder strap 116 and the second shoulder strap 118 may support the support garment 110 on the wearer's shoulders, and the underband 119 may at least partially circumscribe a torso of the wearer. In addition, the support garment 110 includes a neck opening 120 and a torso opening 122. The neck opening 120 is defined, formed, and/or circumscribed at least in part by the first shoulder strap 116 and the second shoulder strap 118 and by upper extents or margins (e.g., neck opening edge 124) of the front portion 112 and the back portion 114. The torso opening 122 is defined at least in part by a torso opening edge 126, which may be the lower edge of the underband 119 and/or the lower edge of the front portion 112 and the back portion 114. FIG. 1 depicts a bra, and in other examples the support garment 110 may include a variety of other types of support garments that include the same or similar elements.

In examples of the present disclosure, at least a portion of the support garment 110 (e.g., the front portion 112) may include a multilayer structure. For instance the front portion 112 includes a first layer 128 (e.g., first breast-covering layer) and a second layer 130 (e.g., second breast-covering layer). The first layer 128 may also be described as an outer layer or an exterior layer, and the second layer 130 may be described as an inner layer or interior layer (e.g., relative to the first layer 128). For example, when the support garment 110 is worn, at least a portion of the second layer 130 may be positioned closer to the wearer than the first layer 128 and/or may be positioned between the first layer 128 and the wearer.

In examples, the multilayer structure may contribute to various operations and features of the support garment 110. For example, in at least some instances, an object may be retained between the first layer 128 and the second layer 130, such as a breast pump, breast prosthetic, pad, protective article, and the like. In this sense, one or more compartments (e.g., interlayer compartments) may be provided between the first and second layers 128 and 130. In addition, a multilayer structure may provide an ability to incorporate into the support garment 110 different materials having different properties. For example, the first layer 128 and the second layer 130 may be constructed of different materials, the combination of which may provide different properties of the support garment 110 (e.g., breathability, permeability, support, comfort, softness, modesty, moisture obfuscation, etc.). Examples of materials may include, but are not limited to, knit textiles, woven textiles, non-woven textiles, meshes, spacer meshes, foam sheets/padding, and the like.

In addition, the first layer 128 may include a first breast-covering portion 132, a second breast-covering portion 134, and a first middle region 136 located between the first and second breast covering portions 132 and 134. In examples, the first breast-covering portion 132 may be releasably coupled to the first shoulder strap 116, and the second breast-covering portion 134 may be releasably coupled to the second shoulder strap 118. For example, an upper extent 138 (e.g., edge, apex, or extension) of the first breast-covering portion 132 may releasably attach to the first shoulder strap 116, and similarly, an upper extent 140 (e.g., edge, apex, or extension) of the second breast-covering portion 134 may releasably attach to the second shoulder strap 118. Various releasable couplings may be used to attach the breast-covering portions to the shoulders straps, such as snaps, clips, buckles, hooks, posts, and the like.

Among other things, the releasable attachment of the first and second breast-covering portions 132 and 134 may provide easier access to the space or compartment(s) between the first layer 128 and the second layer 130.

Figure 2:
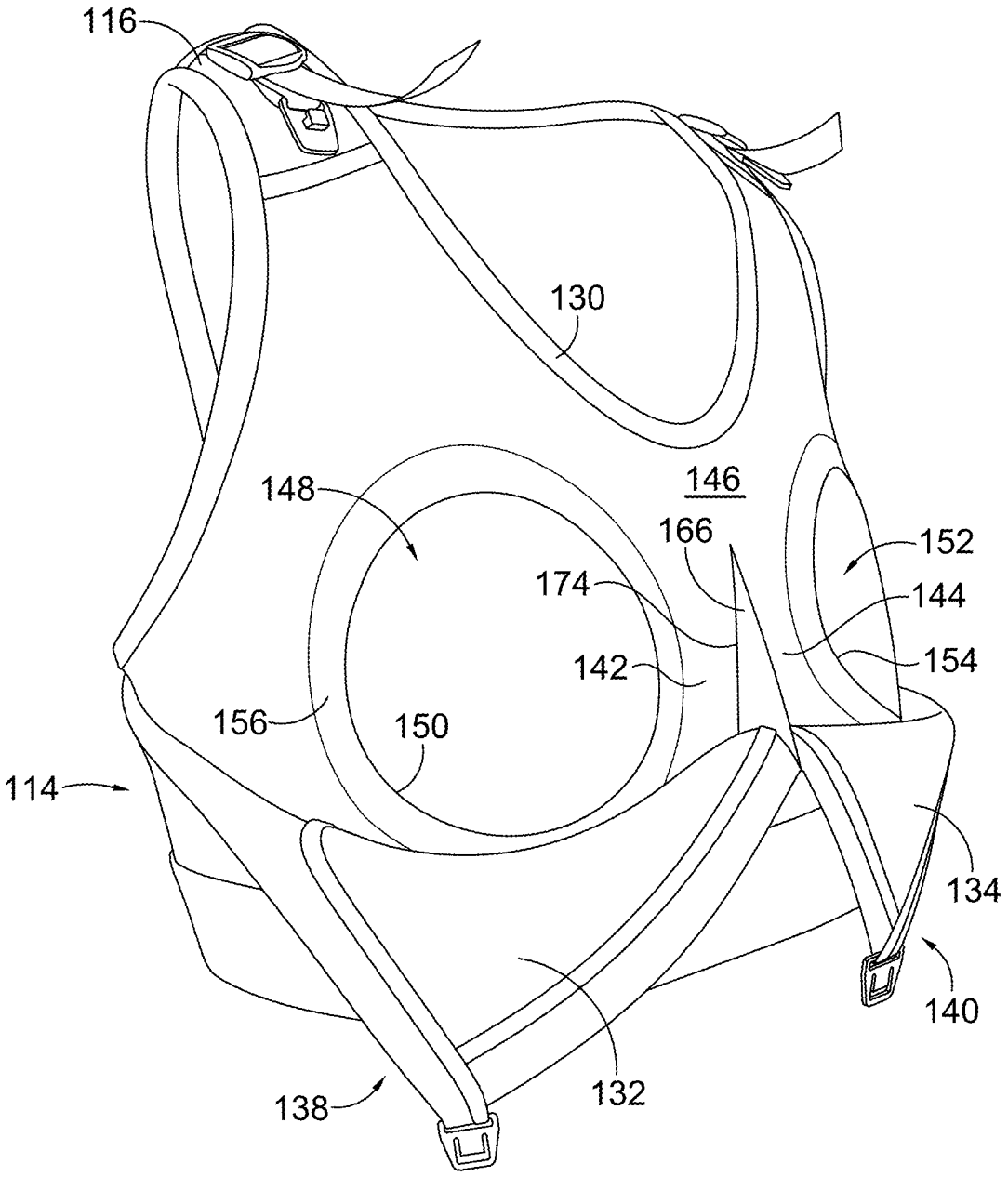
FIG. 2 depicts a perspective view of the support garment in FIG. 1 in a different state (e.g., where a first layer is folded down), in accordance with an aspect of the present disclosure.

FIG. 1 depicts the first breast-covering portion 132 and the second breast-covering portion 134 coupled to a respective shoulder strap 116 and 118. Referring to FIG. 2, the first breast-covering portion 132 and the second breast-covering portion 134 are decoupled from the respective shoulder straps 116 and 118 and are folded downward to reveal other features of the present disclosure. In at least some examples, the second layer 130 may include a third breast-covering portion 142, a fourth breast-covering portion 144, and a second middle region 146 between the third breast-covering portion 142 and the fourth breast-covering portion 144. In addition, the third breast-covering portion 142 may include a first opening 148 bounded or formed by a first perimeter edge 150, and the fourth breast-covering portion 144 may include a second opening 152 bounded or formed by a second perimeter edge 154.

The first opening 148 and the first perimeter edge 150 may include various elements, and although the second opening 152 may not be explicitly described, it is understood that in some examples the second opening 152 and the second perimeter edge 154 may include similar elements. In examples, the first perimeter edge 150 may include an opening profile that defines a shape and size of the first opening 148, and in some instances, the opening profile may correspond with an object to be retained in the compartment between the first breast-covering portion 132 and the third breast-covering portion 142. For example, the opening profile defined by the first perimeter edge 150 may include any combination of one or more of spherical elements, ellipsoid elements, ovoid elements, horseshoe, and/or pyriform/conical elements. In some examples, the opening profile may be egg-shaped or pear-shaped or circular. In some examples, the opening profile may correspond with a shape associated with a breast pump (e.g., a hands-free breast pump), such as a shape that corresponds with at least a part of a flange or shield of the breast pump. For instance, at least a portion of the flange may be inserted through the first opening 148 and positioned between the inner surface of the third breast-covering portion 142 and the wearer's skin surface. In addition, if the support garment 110 is used for nursing an infant, the opening profile is configured to accommodate an infant's mouth and portions of the infant's face.

In at least some examples, at least some portions of the second layer 130, including the third breast-covering portion 142 and the fourth breast-covering portion 144, may be formed of an elastically resilient mesh material. The use of an elastically resilient mesh material for the second layer may facilitate permeability and breathability and allows the material to conform to the shape of the wearer's breasts, thus improving wearer comfort. Moreover, the elastically resilient material surrounding the openings 148 and 152 in the second layer 130 may help to secure, for example, the flange of the breast pump against the wearer's skin surface. In some examples, the second layer can include a single layer of a mesh textile. In some instances, the second layer 130 can include two or more layers of mesh material. In some examples, the second layer can include a variety of other types of materials, instead of, or in addition to mesh, such as other knit textiles, woven textiles, non-woven textiles, spacer textiles, foam sheets/padding, films, and the like.

In addition, at least a portion of the first perimeter edge 150 may be reinforced with a trim piece or other edge reinforcement 156, which may increase the structural integrity of the edge and/or decrease the likelihood that the first perimeter edge 150 might create discomfort for a wearer (e.g., from rubbing or irrigation). In some examples, the reinforcement 156 may include flocking or some other treatment that enhances softness or other material properties. In some instances, the reinforcement 156 can include an edge binding and/or seam or stitch (e.g., serger). In examples, based at least in part on the edge reinforcement 156, the first perimeter edge 150 may be less likely to lose shape or tear (e.g., due to repeated engagement with a breast pump).

Figure 3:
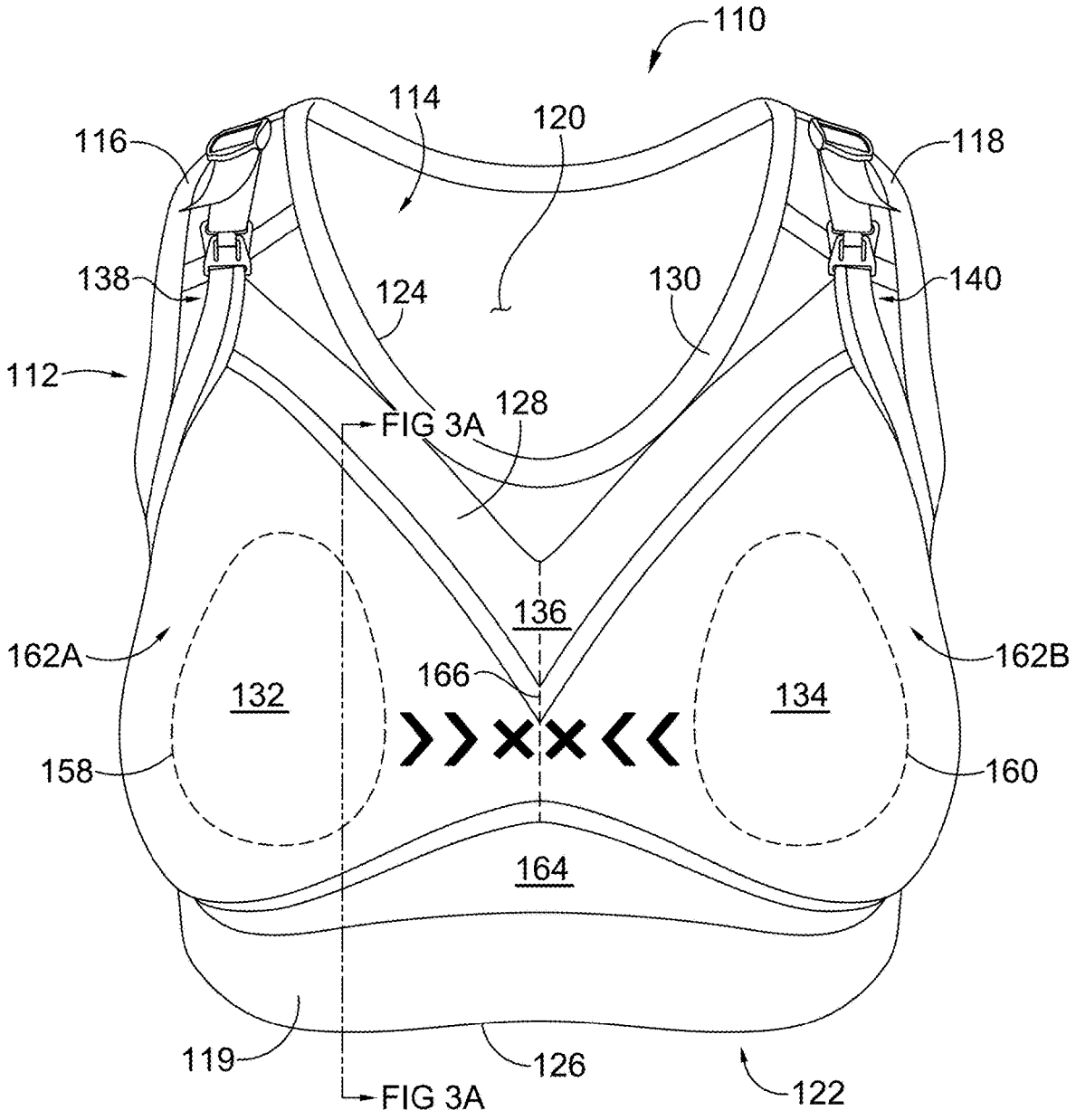
FIG. 3 depicts a support garment with a first object and a second object, in accordance with an aspect of the present disclosure.
Figure 3A:
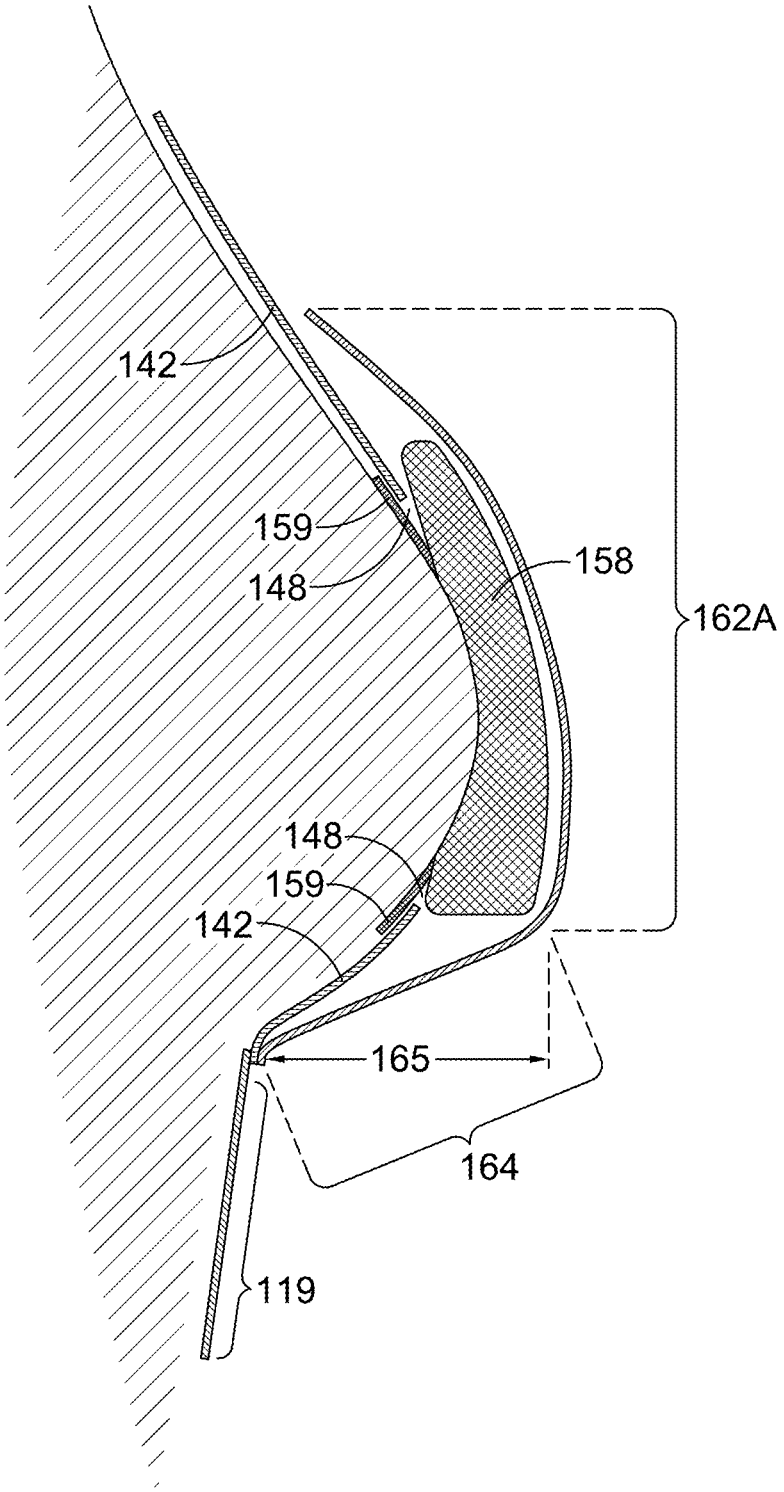
FIG. 3A depicts a cross section identified in FIG. 3, in accordance with an aspect of the present disclosure.

Referring now to FIG. 3, the support garment 110 is depicted, including a first object 158 (e.g., first hands-free breast pump) and a second object 160 (e.g., second hands-free breast pump) retained between the first layer 128 and the second layer 130. The first object 158 and the second object 160 are depicted by broken lines, which indicate they are at least partially obscured from view by the first layer 128. In at least some examples, the first object 158 may be retained in a first interlayer compartment between the first breast-covering portion 132 and the third breast-covering portion 142, and the second object 160 may be retained in a second interlayer compartment between the second breast-covering portion 134 and the third breast-covering portion 142. For example, the first breast-covering portion 132 and/or the second breast-covering portion 134 may be detached from a respective strap in order to provide less obstructed access to the openings 148 and 152 for securing a breast pump for breast-milk pumping. Once the breast pump is in position, the first breast-covering portion 132 and/or the second breast-covering portion 134 may be reattached to a respective strap. In some examples, the portions 132 and 134 can be left detached from respective straps.

In some examples (not explicitly depicted), the first breast-covering portion 132 and/or the second breast-covering portion 134 may be more permanently affixed to the second layer 130, such as by stitching, adhesive, thermal bonding, integral knitting, and the like. In such configuration, the first object 158 and/or the second object 160 (e.g., hands-free breast pumps) may be inserted between free edges of the first layer 128 and the second layer 130 and manipulated into position. In addition, the multilayer constructions can still be effective to retain the object in position based on the various features of the support garment 110, such as the various gussets and combinations of different materials.

In some examples, the first layer 128 may include a central region (e.g., comprised of a first central region 162*a* and a second central region 162*b* as depicted in FIG. 3) and a lower section 164, which is positioned between the central regions 162*a* and 162*b* and the underband 119. The central region may include a continuous region that spans between the first breast-covering portion 132 and the second-breast covering portion 134. For example, the central region 162*a* may extend in a substantially uninterrupted manner with the central region 162*b* (e.g., the central regions 162*a* and 162*b* are a continuous panel or are coupled directly to one another at a seam). However, in some instances, the first breast covering portion 132 and the second breast covering portion 134 may include respective central regions (e.g., the central regions 162*a* and 162*b* are separated by some additional panel of the first layer 128 forming a bridge between the two central regions 162*a* and 162*b*). The central regions 162*a* and 162*b* may have various sizes, and in some examples, a size of the central regions 162*a* and 162*b* is configured to cover at least a portion of the first opening 148 and the second opening 152 (e.g., all of the first opening 148 and the second opening 152).

The central regions 162*a* and 162*b* and the lower section 164 may be constructed of various materials. For instance, the central regions 162*a* and 162*b* may include a relatively low-stretch material and the lower section 164 formed of a relatively high-stretch material (e.g., elastically resilient mesh). In addition, the relatively low-stretch material of the central regions 162*a* and 162*b* may have a stretch characteristic lower than the stretch characteristic of, for example, the third breast-covering portion 142 and the fourth breast-covering portion 144 (e.g., lower than the portions surrounding the openings 148 and 152). In some examples, the central regions 162*a* and 162*b* may comprise one or more of a knit textile, woven textile, non-woven textile, spacer mesh, foam layer. For example, the central regions 162*a* and 162*b* may include a combination of a mesh, spacer mesh, and foam (e.g., open cell foam), which may combine to provide a relatively low-stretch material that is also comfortable, breathable, and permeable.

In some examples, a bottom edge of the lower section 164 may be secured directly to the underband 119. As such, the lower section 164 formed of the relatively high-stretch material may act as an expandable gusset that may expand to accommodate the first object 158 and/or the second object 160 (e.g., a breast pump, a prosthetic, and the like). In addition, the central regions 162*a* and 162*b* formed of the lower-stretch material may be positioned to overlay a nipple area of the wearer or other central portion of the wearer's breast area. When, for example, a breast pump is attached to the wearer's nipple, the low-stretch central region 162 helps to secure or seat the pump against the wearer's breast and minimize shifting of the pump during use. For example, referring to cross section 3A-3A, the breast pump 158 (e.g., hands-free breast pump) is positioned such that a flange 159 has been inserted through the opening 148 and is retained interior to an inner surface of the third breast-covering portion 142. In addition, the lower section 164 has expanded in a direction of the arrow 165 to help accommodate the breast pump 158, while the lower-stretch central region 162*a* can help reduce shifting. In addition, when a breast pump is not retained within the support garment 110 (e.g., normal use), the lower-stretch central regions 162*a* and 162*b* and/or the higher-stretch lower section 164 may (e.g., in combination) provide a level of support conducive to physical activity.

Although the object 158 is described as a breast pump, in other aspects, the object 158 may be a prosthetic. For example, the prosthetic may include a flange or other extension that inserts through the opening 158 and is retained against the wearer's skin surface. As such, the third breast-covering portion 142, which can include the higher-stretch material, and the central portion 162*a* (which can include the lower-stretch material) may help retain the prosthetic in position, while the lower section 164 can expand to help accommodate the added volume. In some instances, a prosthetic may not include a flange, and as such, in at least some examples, the opening 148 may be omitted from the third breast-covering portion 142.

Figure 4:
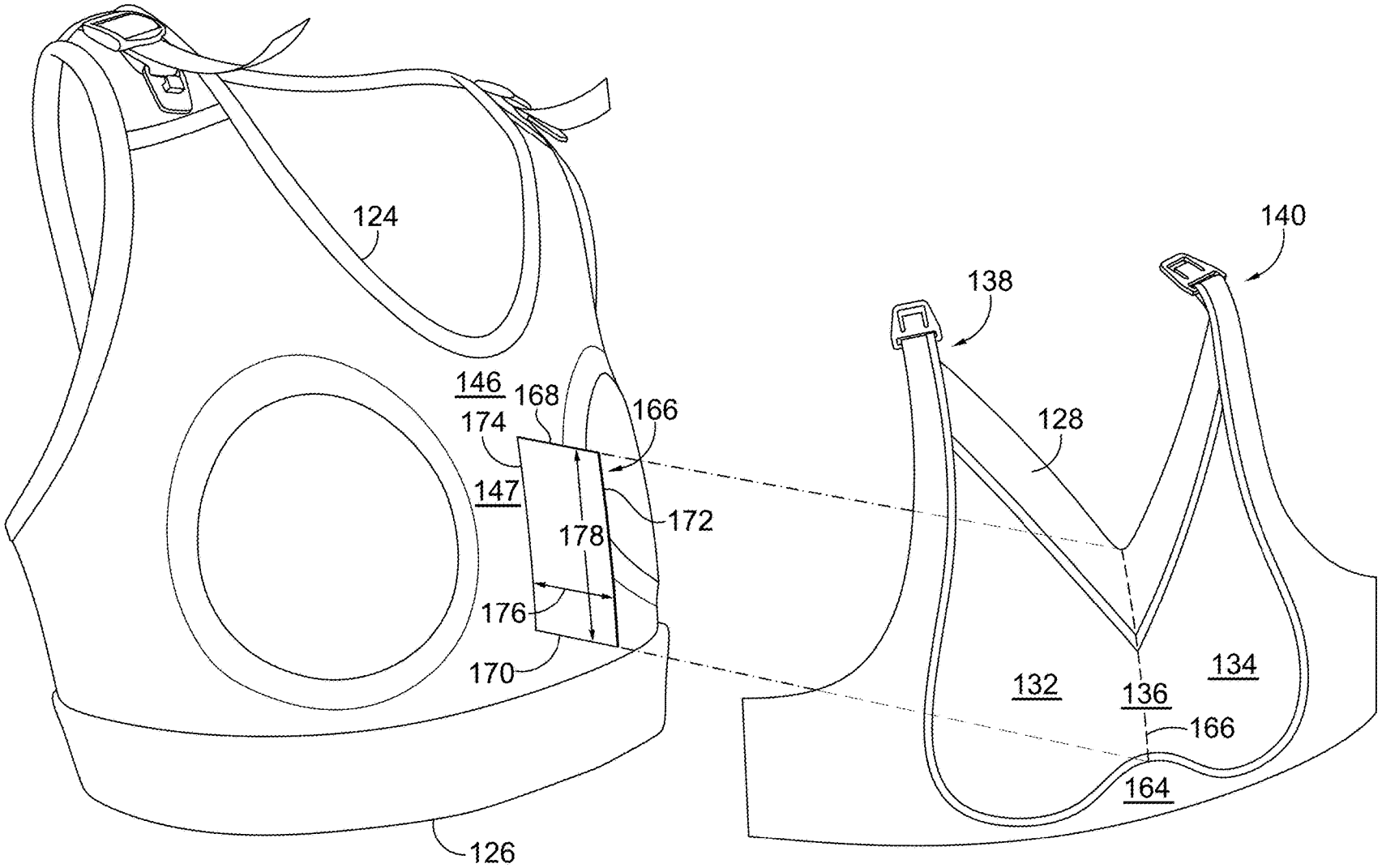
FIG. 4 depicts an outer layer of the support garment partially omitted to show a material extension, in accordance with an aspect of the present disclosure.

In another example, the present disclosure may include a material extension 166 (e.g., gusset or other panel structure) secured near a central region (e.g., bridge or other portion between breast-covering portions) of the support garment. The material extension 166 (obscured from direct view in FIG. 3 but indicated by a broken line) may be seen in FIG. 4, which depicts the support garment 110 with at least a portion of the first layer 128 omitted to reveal the material extension 166. In some examples, the material extension 166 may form a divider between interlayer compartments, and the material extension 166 may help retain the objects 158 and 160 in position and reduce the likelihood that one or more of the objects 158 or 160 might shift positions while contained in the interlayer compartments.

The material extension 166 may include a panel of material (e.g., elastically resilient mesh) that connects the first middle region 136 of the first layer 128 to the second middle region 146 of the second layer 130. In addition, the material extension 166 may extend from a first end 168 (e.g., upper end or other upper extent) oriented towards the neck opening edge 124 to a second end 170 (e.g., lower end or other lower extent) oriented towards the torso opening edge 126. In addition, the material extension 166 may include a first edge 172 secured to the first layer 128 (e.g., to an inner surface of the first middle region 136) and a second edge 174 secured to the second layer 130 (e.g., to an outer surface 147 of the second middle region 146).

Furthermore, the material extension 166 may include a width 176 extending between the first edge 172 and the second edge 174, and a length 178 extending between the first end 168 and the second end 170. In example aspects, the width 176 is from about 1 cm to about 4 cm. In addition, the length 178 can be configured to extend from a top edge of the first layer 128 to an interface between the central region of the first layer (e.g., 162*a* and/or 162*b*) and the lower section 164. In some examples, the top edge of the first layer 128 can extend higher than the first end 168.

In examples of this disclosure, the material extension 166 and related construction may help to create two separate compartments, where each compartment may accommodate, for example, a breast pump or a prosthetic. In examples, the material extension 166 helps to seat the breast pumps or prosthetics such that they do not shift past the midline of the support garment 110 when positioned within one of the compartments. Further, using a material extension having the width 176 between the first edge 172 and second edge 174 (instead of simply securing the first and second middle regions together using stitching) may provide the compartments with a greater volume to better accommodate the volume of the breast pump or prosthetic making the support garment more comfortable to wear.

In at least an example, the first and second middle regions 136 and 146 may be coupled directly together along a seam. For example, the material extension 166 may be omitted, and the first and second middle regions 136 and 146 may be connected by stitching, bonding, integral knitting, and the like. The first middle region 136 may include a higher-stretch material, while the breast-covering portions 132 and 134 can still include a lower-stretch material, such that the higher-stretch material in the middle region 136 may expand away from the seam in order to accommodate a breast pump or other object. In some examples in which the first middle region 136 is coupled directly to the second middle region 146, the first middle region 136 can include a lower-stretch material (e.g., relative to the lower section), such that the lower section 164 provides an expansion functionality to accommodate the added volume.

Referring now to FIGS. 5, 6, 7, 8A and 8B, and 9 an example support garment 210 is depicted, and the support garment 210 includes various features that provide the functionality to retain a wearable or hands-free breast-milk pump (or other device). In addition, the support garment 210 can include other features as well, such as compressive and/or encapsulative support, breathability, moisture wicking, moisture obfuscation, and the like.

The support garment 210 can include many of the same or equivalent features as the support garment 110, and for brevity, at least some of those features may not be explicitly described again in relation to FIGS. 5-9 but would be understood by an ordinary skilled artisan. Examples of similar or same components can include a front portion 212; a back portion 214; a first shoulder strap 216; a second shoulder strap 218; and an underband 219; a neck opening 220; a neck opening edge 224; and a torso opening 222. In addition, the front portion 212 can include include a first layer 228 (e.g., first breast-covering layer or first panel) and a second layer 230 (e.g., second breast-covering layer or second panel), which can be described as an outer layer/panel or an exterior layer/panel and as an inner layer/panel or interior layer/panel, respectively.

Similar to the support garment 110, in at least some instances, an object may be retained between the first layer 228 and the second layer 230, such as a breast pump, breast prosthetic, pad, protective article, and the like. In this sense, one or more compartments (e.g., interlayer compartments) may be provided between the first and second layers 228 and 230. In addition, a multilayer structure may provide an ability to incorporate into the support garment 210 different materials having different properties. For example, the first layer 228 and the second layer 230 may be constructed of different materials, the combination of which may provide different properties of the support garment 210 (e.g., breathability, permeability, support, comfort, softness, modesty, moisture obfuscation, etc.). Examples of materials may include, but are not limited to, knit textiles, woven textiles, non-woven textiles, meshes, spacer meshes, foam sheets/padding, and the like.

In addition, the first layer 228 may include a first breast-covering portion 232, a second breast-covering portion 234, and a first middle region 236 located between the first and second breast covering portions 232 and 234. In examples, the first breast-covering portion 232 may be releasably coupled to the first shoulder strap 216, and the second breast-covering portion 234 may be releasably coupled to the second shoulder strap 218. Various releasable couplings may be used to attach the breast-covering portions to the shoulders straps, such as snaps, clips, buckles, hooks, posts, and the like. Among other things, the releasable attachment of the first and second breast-covering portions 232 and 234 may provide easier access to the space or compartment(s) between the first layer 228 and the second layer 230.

Figure 5:
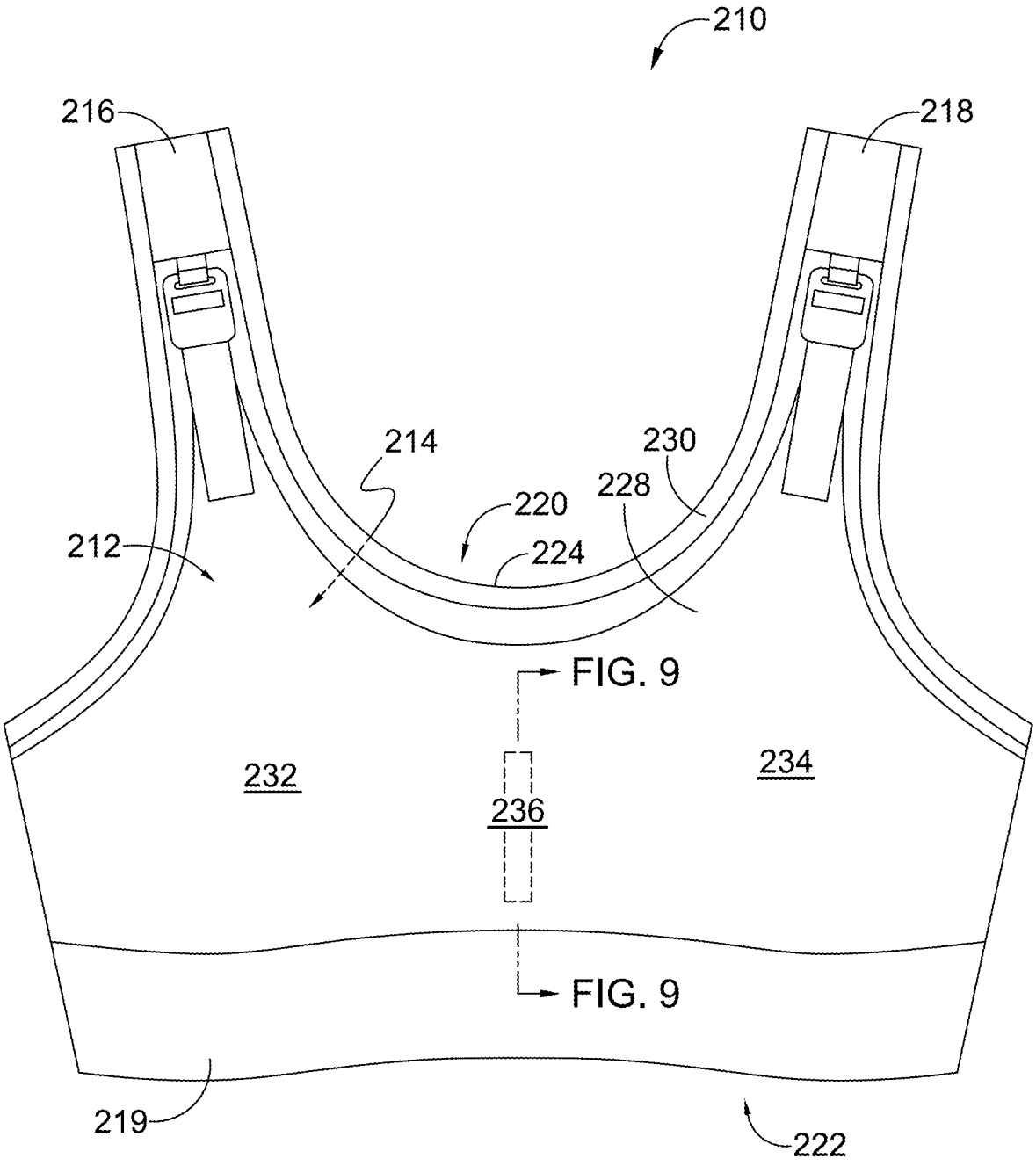
FIG. 5 depicts another support garment in accordance with an example of the present disclosure.
Figure 6:
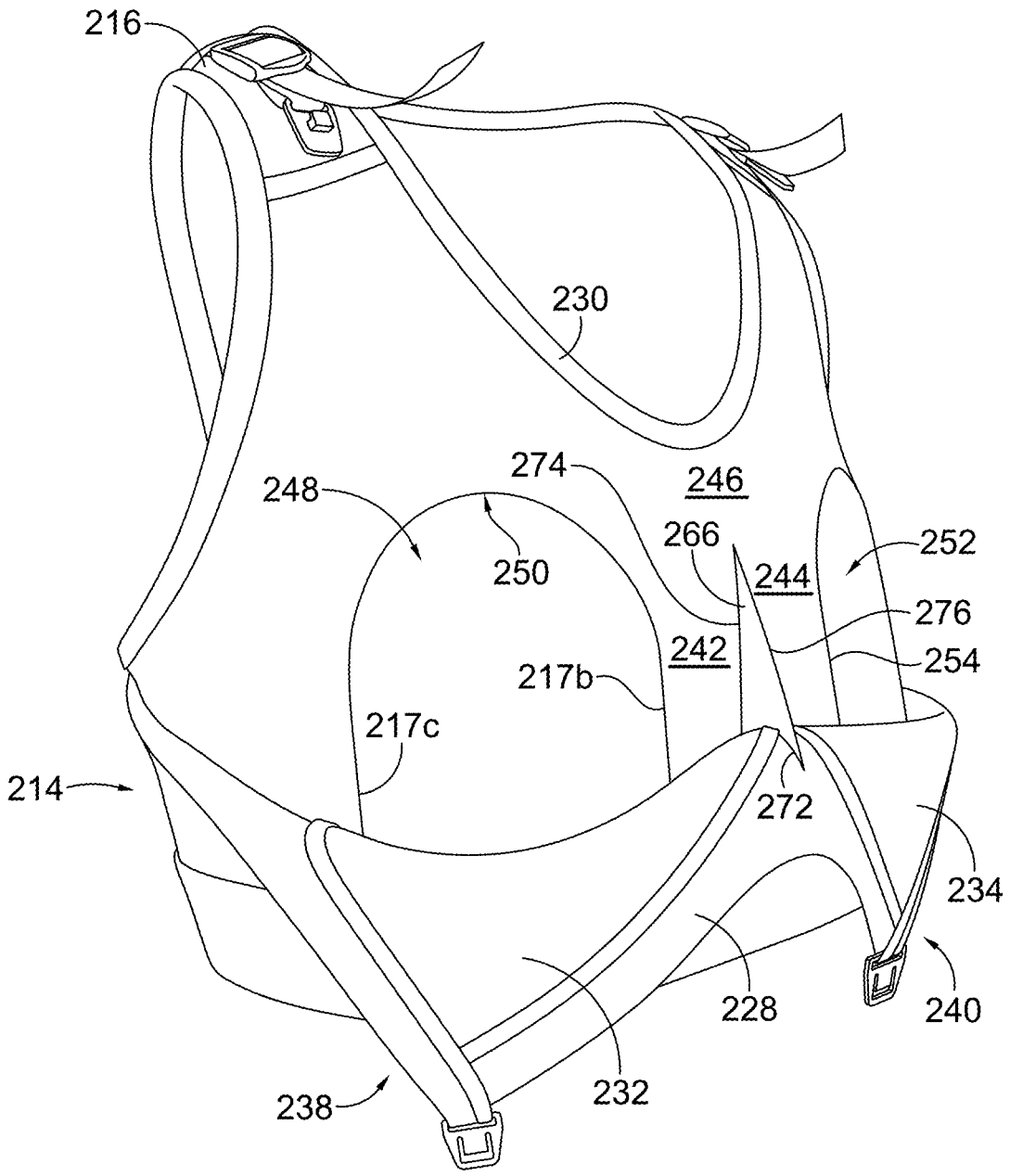
FIGS. 6 and 7 depict an inner layer of the support garment of FIG. 5 in accordance with an example of the present disclosure.

FIG. 5 depicts the first breast-covering portion 232 and the second breast-covering portion 234 coupled to a respective shoulder strap 216 and 218. Referring to FIG. 6, the first breast-covering portion 232 and the second breast-covering portion 234 are decoupled from the respective shoulder straps 216 and 218 and are folded downward to reveal other features of the present disclosure. In at least some examples, the second layer 230 may include a third breast-covering portion 242, a fourth breast-covering portion 244, and a second middle region 246 between the third breast-covering portion 242 and the fourth breast-covering portion 244. In addition, the third breast-covering portion 242 may include a first opening 248 bounded or formed by a first perimeter edge 250, and the fourth breast-covering portion 244 may include a second opening 252 bounded or formed by a second perimeter edge 254.

The garment 210 can operate in a manner similar to the garment 110 (e.g., such as described with respect to FIG. 3), to retain an object (e.g., wearable breast pump) in a space or compartment between the layers 228 and 230.

Figure 7:
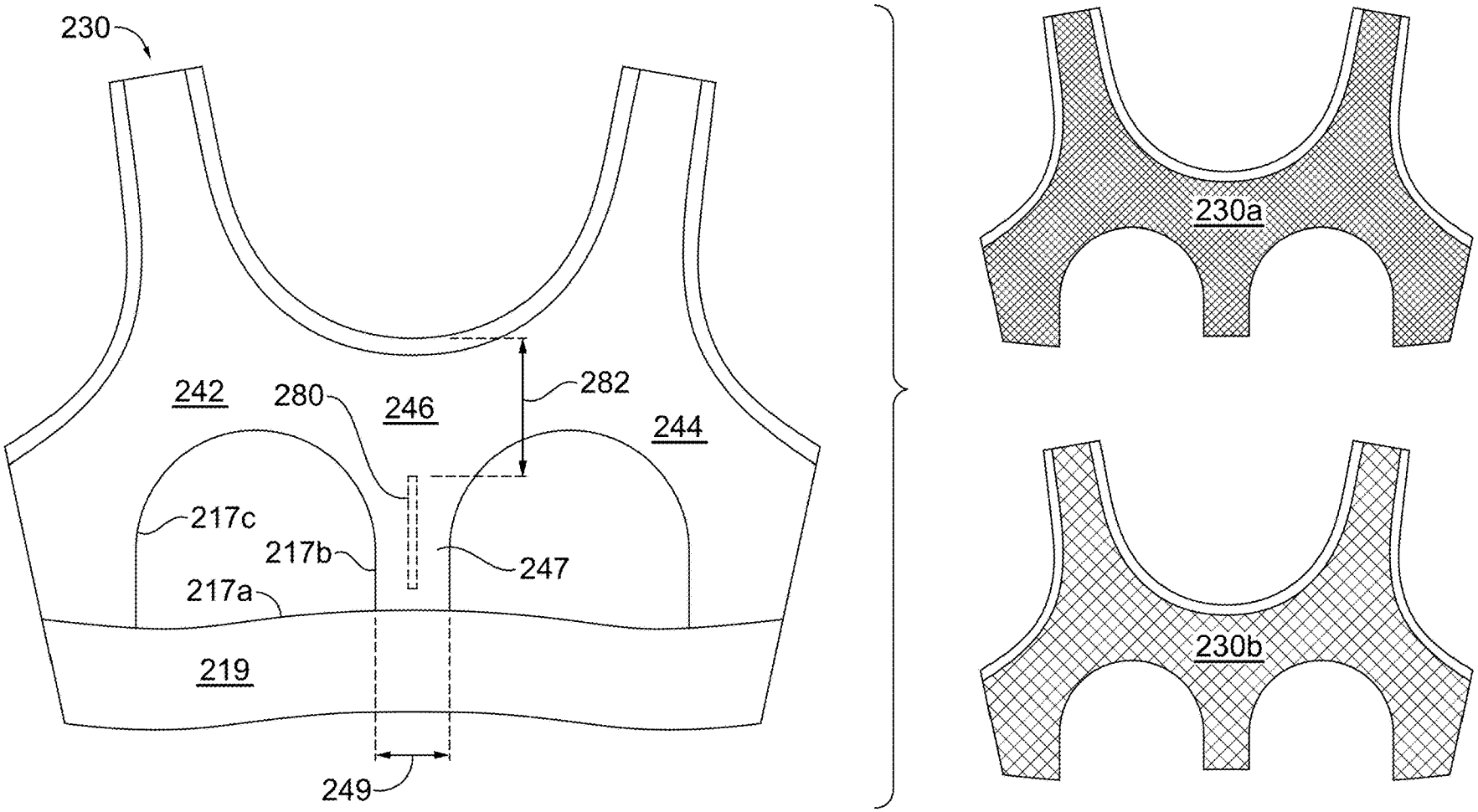

In examples, the first perimeter edge 250 may include an opening profile that defines a shape and size of the first opening 248. As depicted in FIGS. 6 and 7, the opening profile can include an upside-down horseshoe or other shape with a curved top edge (e.g., semi-circular or semi-ovular). In some examples, the bottom edge of the opening is comprised of a top edge 217*a* of the underband 219, which can be relatively straight. In some examples, this larger opening profile having a bottom edge positioned lower on the garment (e.g., as compared with an opening that terminates above the underband) can be more comfortable for some wearers, based on the rounded top edge conforming to an upper portion of the wearer's chest or breast, while the absence of a lower edge can reduce rubbing or discomfort. In addition, by omitting a band of the inner layer 230 that would otherwise form a lower edge of the opening, the construction can avoid the possibility of material wear over time that could contribute to the inner layer 230 being less effective or functional (e.g., due to overstretching or other wear-related conditions).

The first perimeter edge 250 can include other features as well associated with a shape or profile. For example, a profile or shape of the first perimeter edge 250 can include a relatively straight medial edge 217*b*, a relatively straight lateral edge 217*c*, or a combination thereof. In some examples, an orientation of the medial edge 217*b* and/or the lateral edge 217*c* can be based on the edge 217*a*. For example, the medial edge 217*b* and/or the lateral edge 217*c* can comprise an angle with respect to the edge 217*a* in a range of about 75 degrees to about 105 degrees. In some examples, the angle can be about 90 degrees or substantially perpendicular. In some examples, the medial edge 217*b* associated with the opening 250 can be substantially parallel (e.g., within 15 degrees of parallel) with a medial edge associated with the opening 252. In at least some examples, the profile associated with the openings 250 and 252 omits material in the lower medial and lower lateral quadrant that could otherwise contribute to discomfort around the breast tissue (e.g., due to chaffing or hot spots). In at least some examples, when assessing the properties of the opening or of the profile of the opening (e.g., the profile shape or relationships of edges), the properties are assessed with the inner layer 230 being flat (e.g., as depicted in FIG. 7)

Referring to FIG. 7, in some examples the inner layer 230 includes a center bridge 247 between the respective medial edges of the openings 250 and 252. In at least some examples, a width 249 of the center bridge 247 is configured to reduce the likelihood of discomfort along the medial portions of the breasts. For example, the center bridge 247 can include the width 249 that is large enough to maintain the structural integrity of the inner layer 230 and small enough to reduce the likelihood of skin irritation along the medial portions of the breasts. In some examples, based on an objective of maintaining a thinner band associated with the center bridge 247, the width 249 might grade differently as compared with other parts of the garment 210. In some examples, the width 249 may not change as between sizes of garments 210, since the minimum width for structural integrity for a smaller size may likely provide sufficient structural integrity for a larger size. For example, a garment 210 that is sized as relatively small might have a width 249 that is the same as a garment 210 that is sized as relatively large, even though other parts of the respective garments might grade differently (e.g., the circumference of the underbands are different). As a result, across a large array of garments having the same features as associated with FIGS. 5-9, the widths 249 may be the same.

The opening profile in FIGS. 6 and 7 is an example. In other examples, the opening profile may correspond with an object to be retained in the compartment between the first breast-covering portion 232 and the third breast-covering portion 242. For example, the opening profile defined by the first perimeter edge 250 may include any combination of one or more of spherical elements, ellipsoid elements, ovoid elements, horseshoe, and/or pyriform/conical elements. In some examples, the opening profile may be egg-shaped or pear-shaped or circular. In some examples, the opening profile may correspond with a shape associated with a breast pump (e.g., a hands-free breast pump), such as a shape that corresponds with at least a part of a flange or shield of the breast pump.

In at least some examples, at least some portions of the second layer 230, including the third breast-covering portion 242 and the fourth breast-covering portion 144, may be formed of an elastically resilient mesh material. The use of an elastically resilient mesh material for the second layer may facilitate permeability and breathability and allows the material to conform to the shape of the wearer's breasts, thus improving wearer comfort. Moreover, the elastically resilient material surrounding the openings 248 and 252 in the second layer 230 may help to secure, for example, the flange of the breast pump against the wearer's skin surface.

In some examples, the second layer can include a single layer of a mesh textile.

In some instances, the second layer 230 can include two or more layers of mesh textiles, which can be attached to one another (e.g., by a seam along the edge or perimeter) as a panel having multiple layers or multiple textile layers. For example, the second layer can include a first layer 230*a* (e.g., inner layer) of a mesh textile and a second layer (e.g., outer layer) of a mesh textile 230*b*. In some examples, the first layer 230*a* and the second layer 230*b* can include one or more different textile properties that contribute to the overall functionality of the second layer 230. Examples of textile properties that can differ as between the first layer 230*a* and the second layer 230*b* can include opening size in the mesh, compositional material of the yarn, yarn diameter, yarn denier, knit-stitch structure(s), post-processing enhancements, stitch tension, and the like. In some examples, the first layer 230*a* and the second layer 230*b* can have different elongation properties, such that when subjected to a given load, one of the layers includes a higher amount of elongation. In some examples, the first layer 230*a* and the second layer 230*b* include different amounts of elastane.

In at least some instances, a double layer mesh panel can include various advantages. For example, mesh textile can confer breathability to the textile, but in some instances, it can be challenging for a single layer of mesh textile to include a combination of both comfort (e.g., softness) and strength. By comprising mesh textiles having different properties, a double mesh first layer 230*b* can include breathability, comfort, and strength.

In at least some examples, the first layer 230*a* is mesh textile (e.g., mesh knit textile) that is softer (e.g., better hand-feel, better drape, and the like) than a different mesh textile of the second layer 230*b*, and the first layer 230*a* can include an innermost skin facing surface (e.g., positioned to contact the skin of the wearer). The softer first layer 230*a* of mesh can, in some instances, include a yarn with a smaller diameter or denier (as compared with the yarn comprising the second mesh layer 230*b*). The softer first layer 230*a* of mesh can, in some instances, include a finer mesh with smaller mesh openings (as compared with the yarn comprising the second mesh layer 230*b*). The softer first layer 230*a* can, in some examples, have a different modulus of elasticity than the second layer 230*b*. For example, the first layer 230*a* can have a lower modulus of elasticity. In some instances, the mesh textile of the first layer 230*a* can include a higher amount of an elastic yarn (e.g., elastane) as compared with the mesh textile of the second layer 230*b*.

In at least some examples, the second layer 230 *b* is a mesh textile (e.g., mesh knit textile) that is stronger (e.g., better burst strength, higher modulus of elasticity, etc.) than a different mesh textile of the first layer 230 *a*. The stronger second layer 230 *b* of mesh can, in some instances, include a yarn with a larger diameter or denier (as compared with the yarn comprising the second mesh layer 230 *b*). The stronger second layer 230 *b* of mesh can, in some instances, include a coarser mesh with larger mesh openings (as compared with the yarn comprising the first mesh layer 230 *a*). The stronger second layer 230 *b* can, in some examples, have a different modulus of elasticity than the softer first layer 230 *a*. For example, the second layer 230 *b* can have a higher modulus of elasticity. In some instances, the mesh textile of the second layer 230 *b* can include a lower amount of an elastic yarn (e.g., elastane) as compared with the mesh textile of the first layer 230 *a*.

In some examples, the second layer can include a variety of other types of materials, instead of, or in addition to mesh, such as other knit textiles, woven textiles, non-woven textiles, spacer textiles, foam sheets/padding, films, and the like.

In examples, at least a portion of the first perimeter edge 250 may be reinforced with a trim piece or other edge reinforcement, which may increase the structural integrity of the edge and/or decrease the likelihood that the first perimeter edge 250 might create discomfort for a wearer (e.g., from rubbing or irrigation). In some examples, the edge finishing can include flocking or some other treatment that enhances softness or other material properties. In some instances, the reinforcement can include an edge binding and/or seam or stitch (e.g., serger). In examples, based at least in part on the edge reinforcement, the first perimeter edge 250 may be less likely to lose shape or tear (e.g., due to repeated engagement with a breast pump).

Figure 8A:
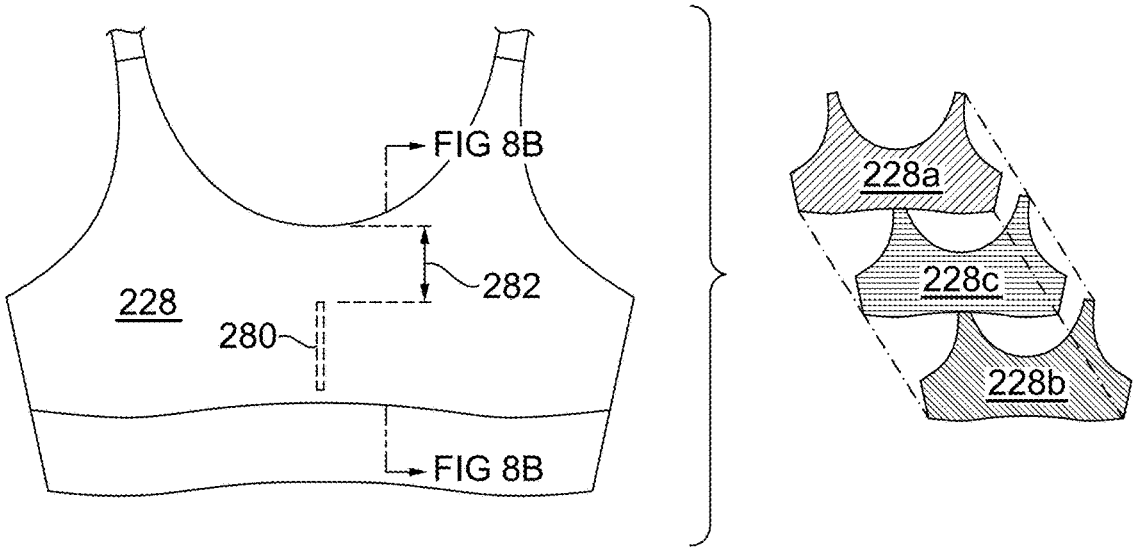
FIG. 8A depicts an outer layer of the support garment of FIG. 5 in accordance with an example of the present disclosure.
Figure 8B:
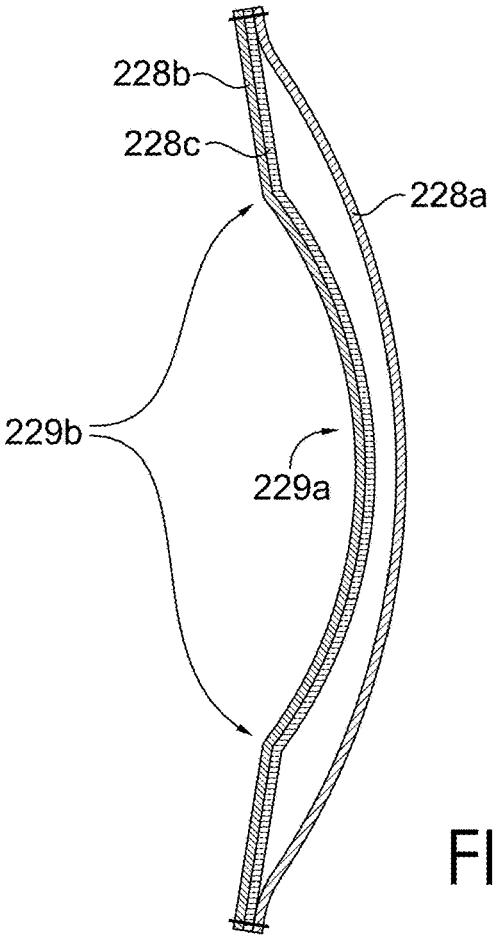
FIG. 8B depicts a cross-sectional view associated with the cross-section reference lines indicated in FIG. 8A, based on an example of this disclosure.
Figure 9:
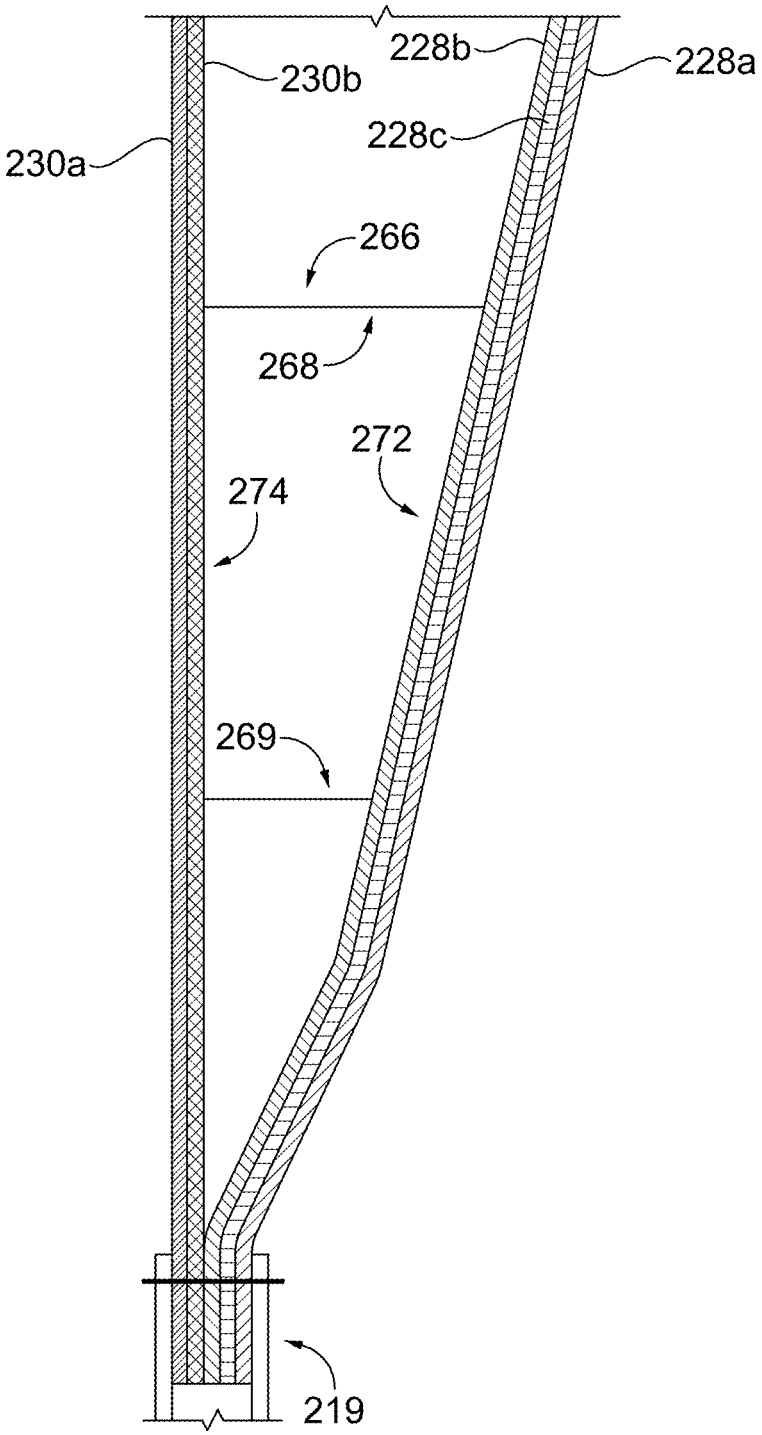
FIG. 9 depicts a cross sectional view based on a reference in FIG. 5, based on an example of this disclosure.

Referring now to FIGS. 8A and 8B, the outer layer 228 can include various properties. In at least one example, the outer layer 228 can include two or more textiles that are coupled to comprise the outer layer 228. The two or more textiles or layers can be attached to one another (e.g., by a seam along the edge or perimeter and/or by lamination) as a panel having multiple layers or multiple textile layers. For example, the two or more textiles can include different sets of material properties that, when combined into the outer layer 228, impart or confer a desired set of overall properties.

In some examples, the outer layer/panel 228 can include an outermost layer 228*a*, an inner layer 228*b*, and a middle layer 228*c* arranged between the outermost layer 228*a* and the inner layer 228*b*.

In at least some examples, the outermost layer 228*a* can include a high support textile that might be more compressive than the textile(s) associated with the layers 228*b* and 228*c*. For example, the outer layer 228*a* can include elastomeric textile (e.g., knit textile comprising elastane).

In at least some examples, the inner layer 228*b* can include a textile configured to obfuscate moisture (e.g., breast milk, sweat, etc.). For example, the inner layer 228*b* can include a spacer knit textile having an inner knit layer that is more hydrophilic, an outer knit layer that is more hydrophobic, and tie yarns (e.g., bare elastic) connecting the inner knit layer and the outer knit layer. In some examples, the inner layer 228*b* can be combined with (e.g., laminate with) a breathable, waterproof membrane.

In at least some examples, the middle layer 228*c* can include a mesh textile configured impart both breathability and strength to the outer layer 228. For example, the middle layer 228*c* can include the same mesh textile as in the layer 230*b* of the of the inner layer 230.

In at least some examples, the inner layer 228*b* and the middle layer 228*c* can be molded to include a concave inner face oriented towards the wearer. For example, as depicted in FIG. 8B, the inner layer 228*b* and the middle layer 228*c* include the concave recess 229*a*, which includes a shoulder 229*b* that transitions between a non-molded portion and the molded portion. In at least some instances, the shoulder 229*b* forms a perimeter around at least a part of the molded portion and can contribute to encapsulative support (e.g., for the breast region) when the outer panel 228 is secured to the shoulder strap. In addition, when a breast pump is secured between the outer layer 228 and the wearer, the shoulder 229*b* can help to impede the breast pump from shifting or sliding out of position.

In at least some examples, while the inner layer 228*b* and the middle layer 228*c* can be molded, the outermost layer 228*a* might not be molded. As such, the outermost layer 228*a* can retain elastic properties that might otherwise be altered by the application of heat and/or pressure in the molding process.

In another example, and similar to the subject matter described with respect to FIGS. 1-4, the present disclosure may include a material extension 266 (e.g., gusset or other panel structure shown in FIG. 6) secured near a central region (e.g., bridge or other portion between breast-covering portions) of the support garment. An illustration of an example of a material extension 266 is provided in FIG. 9, which is a cross-section based on the view in FIG. 5. In some examples, the material extension 266 may form a divider between interlayer compartments, and the material extension 266 may help retain the objects in position and reduce the likelihood that one or more of the objects might shift positions while contained in the interlayer compartments.

The material extension 266 may include a panel of material (e.g., elastically resilient mesh similar to the materials of panels 230*a* and 230*b* or an elastic knit textile similar to the textile of layer 228*a*) that connects the first middle region 236 of the first layer 228 to the second middle region 246 of the second layer 230. The material extension can include similar properties to the material extension 166 described with respect to FIGS. 1-4. For example, the material extension 266 can include a first edge 272 (e.g., outer edge oriented away from the wearer and similar to the edge 172) affixed to the first layer 228 (e.g., at least one layer of the first layer 228); a second edge 274 (e.g., inner edge oriented towards the wearer and similar to the edge 174) attached to the second layer 230 (e.g. at least one layer of the second layer 230); and a top edge 268 (e.g., oriented towards the neck opening and similar to the first end 168) that connects, and creates a span between, the first edge and the second edge. In this sense, the top edge 268 can in some cases be connected to both the first layer 228 and the second layer 230. The material extension 266 can also include a bottom edge 269 that is opposite the top edge and that is oriented towards the underband 219. In at least some examples, the material extension 266 is spaced apart from, and not directly attached to, the underband 219, and as such, a space or gap can exist between the bottom edge 269 and the underband 219.

The edges 272 and 274 can attach to respective layers in various manners. In at least some examples, a seam attaching the edge 272 to the first layer/panel 228 comprises one or more structures (e.g., portions of the edge 272, stitches, seam tape, etc.) that can attach to a surface of (e.g., inner surface), and/or extend through, the inner layer 228*b* without attaching to the outermost layer 228*a*. In some examples, the seam can attach to the layers 228*b* and 228*c*. In some examples, no portion of the seam attaches to the layer 228*a*. In some instances, the seam can be positioned between the layers 228*a*-228*c* without being visible on the outer facing surface of the layer 228*a*. This construction can, in some instances, provide a cleaner aesthetic by limiting seaming (e.g., the visibility of seaming) on the front face of the layer 228*a*.

In at least some instances, a seam attaching the edge 274 to the second layer/panel 230 comprises one or more structures (e.g., portions of the edge 274, stitches, seam tape, etc.) that can attach to a surface of (e.g., outer facing surface), and/or extend through, the outer layer 230*b* without attaching to the innermost layer 230*a*. In some examples, no portion of the seam attaches to the layer 230*a*. In some instances, the seam can be positioned between the layers 230*a*-230*b* without being positioned on the innermost surface of the layer 230*a*. This construction can, in some instances, reduce the likelihood of potential skin irritation by limiting seaming on the inner face of the layer 230*a* that might face towards, and contact, the chest of the wearer.

Furthermore, the material extension 266 may include a width, similar to the width 176. In example aspects, the width of the material extension 266 is from about 1 cm to about 4 cm. In some examples the material extension can be rectangular. In some examples (e.g., FIG. 9), the material extension can taper from a wider top portion to a narrower bottom portion. In some examples, the material extension can be triangular.

Referring to FIGS. 7 and 8A, a dash-line rectangle 280 represents a position at which the material extension might be affixed to the respective layer. In at least some examples, the garment 230 can include an offset 282 between the topline edge of the respective layer (e.g., the neckline) and the upper extent of the connection between the layer and the material extension 266. For example, the offset can be in a range of about 1 in. to about 6 in. Operationally, the offset 282 can allow the outer layer 282 to be more easily folded downward to access the space between the layers, without affecting the ability of the material extension 266 to help retain an object in position and impede shifting.

In examples of this disclosure, the material extension 266 and related construction may help to create two separate compartments, where each compartment may accommodate, for example, a breast pump or a prosthetic. In examples, the material extension 266 helps to seat the breast pumps or prosthetics such that they do not shift past the midline of the support garment 210 when positioned within one of the compartments. Further, using a material extension having the width between the first edge and second edge (instead of simply securing the first and second middle regions together using stitching) may provide the compartments with a greater volume to better accommodate the volume of the breast pump or prosthetic making the support garment more comfortable to wear.

In examples of the present disclosure, one side of the support garment 110 or 210 (e.g., the left side) may mirror the other side of the support garment 110 or 210 (e.g., the right side), such that both the left side and the right side include reflection structural symmetry and include features (e.g., multilayer construction with one or more expansion gussets) for retaining an object. In some examples, the sides of the support garment 110 or 210 may include reflection structural asymmetry, such that one side of the support garment 110 or 210 may include features for retaining an object (e.g., a breast prosthetic), whereas the other side omits one or more of the features. For example, the side of the support garment configured to retain an object (e.g., a breast prosthetic) may include one or more of a multilayer construction with an interlayer compartment, an opening in the inner layer, and/or different material types forming one or more expansion gussets (e.g., along the lower region of the breast covering portion and/or near the midline of the support garment). In addition, the opposing side of the support garment 110 or 210 not configured to retain an object may omit one or more features, such that the opposing side is single layer (as opposed to multilayer) or otherwise does not include an interlayer compartment, includes a solid inner layer that omits an opening, and/or omits one or more expansion gussets. A support garment with reflection structural asymmetry may be useful in various contexts. For example, the support garment 110 or 210 can be customized for wearer that only use a prosthetic breast on one side, but not the other (e.g., the wearer may have natural breast tissue on one side and use a prosthetic on the other side).

Clauses

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

Clause 1. A support garment comprising: a front portion having an neck opening edge and a torso opening edge, the front portion comprising: a first layer having a first breast-covering portion, a second breast-covering portion, and a first middle region positioned between the first breast-covering portion and the second breast-covering portion; a second layer positioned internal to the first layer, the second layer having a third breast-covering portion, a fourth breast-covering portion, and a second middle region positioned between the third breast-covering portion and the fourth breast-covering portion; and a material extension securing the first middle region and the second middle region, the material extension extending from an upper extent to a lower extent, wherein the upper extent is closer, relative to the lower extent, to the neck opening edge, and the lower portion is closer, relative to the upper extent, to the torso opening edge.

Clause 2. The support garment according to clause 1, wherein the third breast-covering portion is positioned internal to the first breast-covering portion, and wherein the fourth breast-covering portion is positioned internal to the second breast-covering portion.

Clause 3. The support garment according to any of clauses 1 through 2, wherein each of the third breast-covering portion and the fourth breast-covering portion includes an opening sized to receive a flange of a breast pump.

Clause 4. The support garment according to clause 3, wherein each of the openings is reinforced with a reinforcement material.

Clause 5. The support garment according to any of clauses 1 through 4, wherein the second layer has a greater stretch characteristic relative to one or more portions of the first layer.

Clause 6. The support garment according to any of clauses 1 through 5, wherein the material extension includes a first edge secured to the first layer, a second edge secured to the second layer, and a width extending between the first edge and the second edge.

Clause 7. The support garment according to clause 6, wherein the width is from about 1 cm to about 4 cm.

Clause 8. The support garment according to any of clauses 1 through 7, wherein the material extension comprises an elastically resilient material.

Clause 9. The support garment according to any of clauses 1 through 8, further comprising an underband that at least partially defines the torso opening edge.

Clause 10. The support garment according to clause 9, wherein the first layer includes a lower section comprising an elastically resilient material, and wherein a bottom edge of the lower section is secured to the underband.

Clause 11. The support garment according to any of clauses 9 through 10, wherein a bottom edge of the second layer is secured to the underband.

Clause 12. The support garment according to any of clauses 1 through 11, further comprising a first shoulder strap extending from an upper edge of the third breast-covering portion and a second shoulder strap extending from an upper edge of the fourth breast-covering portion.

Clause 13. The support garment according to clause 12, wherein an upper edge of the first breast-covering portion is releasably coupled to the first shoulder strap, and wherein an upper edge of the second breast-covering portion is releasably coupled to the second shoulder strap.

Clause 14. A support garment comprising: a front portion having an neck opening edge and a torso opening edge, the front portion comprising: a first layer having a first breast-covering portion, a second breast-covering portion, and a first middle region positioned between the first breast-covering portion and the second breast-covering portion, each of the first breast-covering portion and the second breast-covering portion comprising a central portion formed of a material having a first stretch characteristic and a lower section formed of a material having a second stretch characteristic greater than the first stretch characteristic, wherein a bottom edge of the lower section is secured to an underband; and a second layer positioned internal to the first layer, the second layer having a third breast-covering portion, a fourth breast-covering portion, and a second middle region positioned between the third breast-covering portion and the fourth breast-covering portion, each of the third breast-covering portion and the fourth breast-covering portion comprising an opening sized to receive a flange of a breast pump.

Clause 15. The support garment according to clause 14, further comprising a material extension securing the first middle region and the second middle region, the material extension extending vertically from a location adjacent the neck opening edge to a location adjacent the torso opening edge.

Clause 16. The support garment according to clause 15, wherein the material extension includes a first edge secured to the first layer, a second edge secured to the second layer, and a width extending between the first edge and the second edge.

Clause 17. The support garment according to clause 16, wherein the width is from about 1 cm to about 4 cm.

Clause 18. The support garment according to any of clauses 15 through 17, wherein the material extension comprises an elastically resilient material.

Clause 19. The support garment according to any of clauses 14 through 18, wherein a bottom edge of the second layer is secured to the underband.

Clause 20. The support garment according to any of clauses 14 through 19, wherein the second layer has a stretch characteristic that is greater than the first stretch characteristic.

Clause 21. The support garment according to any of clauses 14 through 20, further comprising a first shoulder strap extending from an upper edge of the third breast-covering portion and a second shoulder strap extending from an upper edge of the fourth breast-covering portion.

Clause 22. The support garment according to clause 21, wherein an upper edge of the first breast-covering portion is releasably coupled to the first shoulder strap, and wherein an upper edge of the second breast-covering portion is releasably coupled to the second shoulder strap.

Clause 23: A support garment comprising: a first breast-covering layer comprising: a first breast-covering portion, a second breast-covering portion, and a first middle region between the first breast-covering portion and the second breast-covering portion; a second breast-covering layer comprising: a third breast-covering portion, a fourth breast-covering portion, and a second middle region between the first breast-covering portion and the second breast-covering portion; and a material extension securing the first middle region and the second middle region.

Clause 24: The support garment of clause 23, wherein: the third breast-covering portion comprises a first opening configured to receive a portion of a first hands-free breast pump; and the fourth breast-covering portion comprises a second opening configured to receive a portion of a second hands-free breast pump.

Clause 25: The support garment of clause 23, further comprising an underband, wherein: the first breast-covering layer comprises a lower section coupled to the underband; the first breast-covering portion comprises a first central region coupled to the lower section; and the first breast-covering portion comprises a relatively low-stretch material and the lower section comprises a relatively high-stretch material.

Clause 26: A support garment comprising: a neck opening and an underband; an outer breast-covering layer and an inner breast-covering layer; the outer breast-covering layer comprising: a first breast-covering portion comprising a central portion formed of a first material and a lower portion formed of a second material, which is more elastic than the first material; and the lower portion coupled to the underband; and the inner breast-covering layer comprising a second breast-covering portion aligned with the first breast-covering portion.

Clause 27: The support garment of clause 26, wherein the second breast-covering portion comprises an opening that is aligned with the first breast-covering portion and that is configured to receive a portion of a hands-free breast pump.

Clause 28. The support garment of clause 26, wherein: the outer breast-covering layer comprises a first middle portion; the inner breast-covering layer comprises a second middle portion; and the support garment further comprises a material extension securing the first middle portion to the second middle portion.

Clause 29. A support garment comprising: a neck opening and an underband; an outer breast-covering layer and an inner breast-covering layer; the outer breast-covering layer comprising: a first breast-covering portion comprising a first central portion formed of a first material and a first lower portion formed of a second material, which is more elastic than the first material; a second breast-covering portion comprising a second central portion formed of the first material and a second lower portion formed of the second material; and the first lower portion and the second lower portion coupled to the underband; the inner breast-covering layer comprising: a third breast-covering portion comprising a first opening and aligned with the first breast-covering portion; and a fourth breast-covering portion comprising a second opening and aligned with the second breast-covering portion; and a material extension securing, at a position between the first breast-covering portion and the second breast-covering portion and between the third breast-covering portion and the fourth breast-covering portion, the outer breast-covering layer to the inner breast-covering layer.

Clause 301. A support garment comprising: a front portion having an neck opening edge and a torso opening edge, the front portion comprising: an outer layer having a first breast-covering portion, a second breast-covering portion, and a first middle region positioned between the first breast-covering portion and the second breast-covering portion; an inner layer positioned internal to the first layer, the inner layer having a third breast-covering portion, a fourth breast-covering portion, and a second middle region positioned between the third breast-covering portion and the fourth breast-covering portion; and a material extension securing the first middle region and the second middle region.

Clause 31. The support garment of clause 30, wherein the material extension comprises a first side edge affixed to the first middle region, a second side edge affixed to the second middle region, and a top edge extending between, and spacing apart, the first side edge and the second side edge.

Clause 32. The support garment of clause 31, wherein the material extension comprises a width extending between the first side edge and the second side edge.

Clause 33. The support garment of clause 32, wherein the width is in a range of about 1 in. to about 4 in.

Clause 34. The support garment of any of clauses 30-33, wherein an upper portion of the material extension is offset below the neck opening edge by an offset distance.

Clause 35. The support garment of clause 34, wherein the offset distance is in a range of about 1 in. to about 6 in.

Clause 36. The support garment of any of clauses 30-35, wherein each of the third breast-covering portion and the fourth breast-covering portion includes an opening configured to receive a portion of a breast pump.

Clause 37. The support garment of clause 36, wherein each of the openings comprises a medial edge and wherein at least a portion of the medial edge is straight.

Clause 38. The support garment of clause 37, wherein at least the portion of the medial edge is substantially perpendicular to a top edge of an underband.

Clause 39. The support garment of clause 38, wherein the top edge of the underband comprises at least a portion of an edge of each of the openings.

Clause 40. The support garment of any of clauses 30-39, wherein the inner layer comprises a first mesh textile having a first set of material properties and a second mesh textile having a second set of material properties, which are different from the first set of material properties.

Clause 41. The support garment of any of clauses 30-40, wherein the outer layer comprises two or more different textile layers.

Clause 42. The support garment of clause 41, wherein the two or more different textile layers comprises an innermost layer comprising a spacer knit textile, a middle layer comprising a mesh textile, and an outermost layer comprising an elastomeric textile.

Clause 43. The support garment of clause 42, wherein at least one of the two or more different textile layers comprises a molded portion, which is at least partially circumscribed by a shoulder that transitions between the molded portion and a non-molded portion.

Clause 44. The support garment of clause 43, wherein at least one of the two or more different textile layers that is an outermost layer does not comprise a molded portion.

Clause 45. A support garment comprising: a front portion having a neck opening edge and a torso opening edge, the front portion comprising: an outer panel and an inner panel positioned internal to the outer panel, wherein each of the outer panel and the inner panel comprises a first breast covering portion, a second breast covering portion, and a middle region between the first breast covering portion and the second breast covering portion; the outer panel comprising a plurality of textile layers that are affixed to one another and that comprises a first textile layer and a second textile layer, which is positioned between the first textile layer and the inner panel; the second textile layer comprising a molded concave portion oriented towards the inner panel, wherein the first textile layer does not include a corresponding molded concave portion; and the first breast covering portion and the second breast covering portion of the inner panel each comprise an opening configured to receive a portion of a breast pump.

Clause 46. The support garment of clause 45, further comprising a material extension securing the middle region of the outer panel to the middle region of the inner panel.

Clause 47. The support garment of clauses 45 or 46, wherein the outer panel further comprises a third textile layer positioned between the first textile layer and the second textile layer.

Clause 48. The support garment of clause 47, wherein the third textile layer comprises a second molded concave portion corresponding with the first molded concave portion.

Clause 49. The support garment of any of clauses 45-48, wherein the second textile layer comprises a spacer knit textile.

Clause 50. The support garment of any of clauses 45-49, wherein the molded concave portion aligns with the opening of the first breast covering portion of the inner panel.

Clause 51. The support garment of any of clauses 45-50, wherein the inner panel comprises a first mesh textile having a first set of material properties and a second mesh textile having a second set of material properties, which are different from the first set of material properties.

Clause 52. A support garment comprising: a front portion having a neck opening edge and a torso opening edge, the front portion comprising: an outer panel and an inner panel positioned internal to the outer panel, wherein each of the outer panel and the inner panel comprises a first breast covering portion, a second breast covering portion, and a middle region between the first breast covering portion and the second breast covering portion; the inner panel comprising a first mesh textile having a first set of material properties and a second mesh textile having a second set of material properties, which are different from the first set of material properties, wherein the second mesh textile is positioned between the first mesh textile and the outer panel; and the first breast covering portion and the second breast covering portion of the inner panel each comprise an opening configured to receive a portion of a breast pump.

Clause 53. The support garment of clause 52, further comprising a material extension securing the middle region of the outer panel to the middle region of the inner panel.

Clause 54. The support garment of clauses 51 or 52, wherein a difference between the first set of material properties and the second set of material properties comprises at least one of a different yarn compositional material, a different yarn denier, a different mesh aperture size, a different stitch type, and a different stitch size.

Clause 55. The support garment of any of clauses 52-54, wherein the first mesh textile is softer than the second mesh textile based on bending properties.

Clause 56. The support garment of any of clauses 52-55, wherein the outer layer comprises two or more different textile layers.

Clause 57. The support garment of any of clauses 52-56, wherein the two or more different textile layers comprises an innermost layer comprising a spacer knit textile, a middle layer comprising a third mesh textile that is a same mesh textile as the second mesh textile, and an outermost layer comprising an elastomeric textile.

Clause 58. A support garment comprising: a front portion having an neck opening edge and a torso opening edge, the front portion comprising: an outer panel having a first breast-covering portion, a second breast-covering portion, and a first middle region positioned between the first breast-covering portion and the second breast-covering portion; an inner panel positioned internal to the first layer, the inner panel having a first opening, a second opening, and a second middle region positioned between the first and the second openings; and a material extension connecting the first middle region and the second middle region.

Clause 59. The support garment of clause 58, wherein a first edge of the material extension is coupled to a portion of the first middle region and is coupled to a portion of the second middle region.

Clause 60. The support garment of clause 58 or 59, wherein the material extension is positioned above an underband of the support garment and below the neck opening edge.

Clause 61. The support garment of any of clauses 58-60, wherein the material extension is not directly secured to the underband or the neck opening edge.

Clause 62. The support garment of any of clauses 58-61, wherein the inner panel comprises a first mesh textile having a first amount of elongation and a second mesh textile having a second amount of elongation greater than the first amount of elongation at a given load.

Clause 63. The support garment of clause 62, wherein the first mesh textile forms an innermost skin facing surface of the inner panel and the second mesh textile forms an outer surface of the inner panel.

Clause 64. The support garment of any of clauses 58-63, wherein the outer panel comprises two or more textile layers.

Clause 65. The support garment of clause 64, wherein at least one of the two or more textile layers are molded.

Clause 66. The support garment of any of clauses 62-65, wherein a first seam connecting the material extension with the inner panel is positioned between the first mesh textile and the second mesh textile.

Clause 67. The support garment of any of clauses 64-66, wherein a second seam connecting the material extension with the outer panel is positioned at an inner surface of the outer panel or between two or more textile layers of the outer panel.

This above detailed description is provided in order to meet statutory requirements. However, this description is not intended to limit the scope of the invention described herein. Rather, the claimed subject matter may be embodied in different ways, to include different steps, different combinations of steps, different elements, and/or different combinations of elements, similar or equivalent to those described in this disclosure, and in conjunction with other present or future technologies. The examples herein are intended in all respects to be illustrative rather than restrictive. In this sense, alternative examples or implementations can become apparent to those of ordinary skill in the art to which the present subject matter pertains without departing from the scope hereof.

What is claimed is:

1. A support garment comprising:

a front portion having a neck opening edge and a torso opening edge, the front portion comprising:

an outer layer having a first breast-covering portion, a second breast-covering portion, and a first middle region positioned between the first breast-covering portion and the second breast-covering portion;

an inner layer positioned internal to the outer layer, the inner layer having a third breast-covering portion, a fourth breast-covering portion, and a second middle region positioned between the third breast-covering portion and the fourth breast-covering portion; and a material extension extending outward between the first middle region and the second middle region, wherein the material extension is a panel of textile material comprising and extending from a first side edge and a second side edge, wherein the first side edge is affixed to the outer layer, the second side edge is affixed to the inner layer, and wherein the material extension extends between the first side edge and the second side edge to provide a volume between the outer layer and the inner layer configured to separate the third breast-covering portion from the fourth breast-covering portion.

2. The support garment of claim 1, wherein the first side edge is affixed to the first middle region and the second side edge is affixed to the second middle region, the material extension further comprising a top edge extending between, and spacing apart, the first side edge and the second side edge.

3. The support garment of claim 2, wherein the material extension comprises a width extending between the first side edge and the second side edge.

4. The support garment of claim 3, wherein the width is in a range of about 1 in. to about 4 in.

5. The support garment of claim 1, wherein an upper portion of the material extension is offset below the neck opening edge by an offset distance.

6. The support garment of claim 5, wherein the offset distance is in a range of about 1 in. to about 6 in.

7. The support garment of claim 1, wherein each of the third breast-covering portion and the fourth breast-covering portion includes an opening configured to receive a portion of a breast pump.

8. The support garment of claim 7, wherein each of the openings comprises a medial edge and wherein at least a portion of the medial edge is straight.

9. The support garment of claim 8, wherein at least the portion is substantially perpendicular to a top edge of an underband.

10. The support garment of claim 9, wherein the top edge of the underband comprises at least a portion of an edge of each of the openings.

11. The support garment of claim 1, wherein the inner layer comprises a first mesh textile having a first set of material properties and a second mesh textile having a second set of material properties, the second set of material properties being different from the first set of material properties.

12. The support garment of claim 11, wherein the outer layer comprises two or more different textile layers.

13. The support garment of claim 12, wherein the two or more different textile layers comprises an inner layer comprising a spacer knit textile, a middle layer comprising a mesh textile, and an outer layer comprising an elastomeric textile.

14. The support garment of claim 12, wherein at least one of the two or more different textile layers comprises a molded portion, which is at least partially circumscribed by a shoulder that transitions between the molded portion and a non-molded portion.

15. The support garment of claim 14, wherein an outermost layer of the two or more different textile layers does not comprise a molded portion.

16. A support garment comprising:

a front portion having a neck opening edge and a torso opening edge, the front portion comprising:

an outer panel and an inner panel positioned internal to the outer panel, wherein each of the outer panel and the inner panel comprises a first breast covering portion, a second breast covering portion, and a middle region between the first breast covering portion and the second breast covering portion;

the outer panel comprising a plurality of textile layers that are affixed to one another, the plurality of textile layers comprising a first textile layer and a second textile layer, the second textile layer being positioned between the first textile layer and the inner panel;

the second textile layer comprising a molded concave portion oriented towards the inner panel, wherein the first textile layer does not include a corresponding molded concave portion;

a material extension extending outward between the middle region of the outer panel and middle region of the inner panel, wherein the material extension is a panel of textile material comprising and extending from a first side edge and a second side edge, wherein the first side edge is affixed to the outer panel, the second side edge is affixed to the inner panel, and wherein the material extension extends between the first side edge and the second side edge to provide a volume between the outer panel and the inner panel; and the first breast covering portion and the second breast covering portion of the inner panel each comprise an opening configured to receive a portion of a breast pump.

17. The support garment of claim 16, wherein the outer panel further comprises a third textile layer positioned between the first textile layer and the second textile layer.

18. The support garment of claim 17, wherein the molded concave portion is a first molded concave portion, and wherein the third textile layer comprises a second molded concave portion corresponding with the first molded concave portion.

19. The support garment of claim 16, wherein the second textile layer comprises a spacer knit textile.

20. The support garment of claim 16, wherein the molded concave portion aligns with the opening of the first breast covering portion of the inner panel.

21. The support garment of claim 16, wherein the inner panel comprises a first mesh textile having a first set of material properties and a second mesh textile having a second set of material properties, the second set of material properties being different from the first set of material properties.

22. A support garment comprising:

a front portion having a neck opening edge and a torso opening edge, the front portion comprising:

an outer panel and an inner panel positioned internal to the outer panel, wherein each of the outer panel and the inner panel comprises a first breast covering portion, a second breast covering portion, and a middle region between the first breast covering portion and the second breast covering portion;

the inner panel comprising a first mesh textile having a first set of material properties and a second mesh textile having a second set of material properties, the second set of material properties being different from the first set of material properties, wherein the second mesh textile is positioned between the first mesh textile and the outer panel;

a material extension extending outward between the middle region of the outer panel and middle region of the inner panel, wherein the material extension is a panel of textile material comprising and extending from a first side edge and a second side edge, wherein the first side edge is affixed to the outer panel, the second side edge is affixed to the inner panel, and wherein the material extension extends between the first side edge and the second side edge to provide a volume between the outer panel and the inner panel; and the first breast covering portion and the second breast covering portion of the inner panel each comprise an opening configured to receive a portion of a breast pump.

23. The support garment of claim 22, wherein a difference between the first set of material properties and the second set of material properties comprises at least one of a different yarn compositional material, a different yarn denier, a different mesh aperture size, a different stitch type, and a different stitch size.

24. The support garment of claim 22, wherein the outer panel comprises two or more different textile layers.

25. The support garment of claim 24, wherein the two or more different textile layers comprises an innermost layer comprising a spacer knit textile, a middle layer comprising a third mesh textile that is a same mesh textile as the second mesh textile, and an outermost layer comprising an elastomeric textile.

26. A support garment comprising:

a front portion having a neck opening edge and a torso opening edge, the front portion comprising:

an outer panel having a first breast-covering portion, a second breast-covering portion, and a first middle region positioned between the first breast-covering portion and the second breast-covering portion;

an inner panel positioned internal to the outer panel, the inner panel having a first opening, a second opening, and a second middle region positioned between the first and the second openings; and a material extension connecting the first middle region and the second middle region, wherein the material extension is a panel of textile material comprising and extending between a first side edge and a second side edge, wherein the first side edge is affixed to the outer panel and the second side edge is affixed to the inner panel, and wherein the material extension extends between the first side edge and the second side edge to provide a volume between the outer panel and the inner panel.

27. The support garment of claim 26, wherein the first side edge is affixed to the first middle region and the second edge is affixed to the second middle region, the material extension further comprising a top edge extending between, and spacing apart, the first side edge and the second side edge.

28. The support garment of claim 26, wherein the material extension is positioned above an underband of the support garment and below the neck opening edge.

29. The support garment of claim 28, wherein the material extension is not directly secured to the underband or the neck opening edge.

30. The support garment of claim 26, wherein the inner panel comprises a first mesh textile having a first amount of elongation and a second mesh textile having a second amount of elongation greater than the first amount of elongation at a given load.

31. The support garment of claim 30, wherein the first mesh textile forms an innermost skin facing surface of the inner panel and the second mesh textile forms an outer surface of the inner panel.

32. The support garment of claim 26, wherein the outer panel comprises two or more textile layers.

33. The support garment of claim 32, wherein at least one of the two or more textile layers are molded.

* * * * *